US007506956B2

(12) United States Patent
Usui

(10) Patent No.: US 7,506,956 B2
(45) Date of Patent: Mar. 24, 2009

(54) PRINTING APPARATUS, PRINTING METHOD, STORAGE MEDIUM, AND PRINTING SYSTEM

(75) Inventor: Toshiki Usui, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 363 days.

(21) Appl. No.: 11/367,299

(22) Filed: Mar. 6, 2006

(65) Prior Publication Data

US 2006/0209111 A1 Sep. 21, 2006

(30) Foreign Application Priority Data

Mar. 4, 2005 (JP) ..... 2005-061188

(51) Int. Cl.
*B41J 2/165* (2006.01)

(52) U.S. Cl. ..... 347/23; 347/29; 347/30; 347/32

(58) Field of Classification Search ..... 347/14, 347/19, 23, 29, 30, 32, 33, 10
See application file for complete search history.

(56) References Cited

FOREIGN PATENT DOCUMENTS

JP 2003-72058 A 3/2003

*Primary Examiner*—Shih-wen Hsieh
(74) *Attorney, Agent, or Firm*—Sughrue Mion, PLLC

(57) ABSTRACT

A printing apparatus includes a carry mechanism, a nozzle, an element, a drive signal outputting section, a temperature sensor, a cap, and a controller. The carry mechanism carries a medium. The nozzle performs a moving-and-ejecting operation of ejecting ink toward the medium while moving relative to the medium during an intermission of a carrying operation performed by the carry mechanism. The element performs an ink ejecting operation for causing the ink to be ejected from the nozzle. The drive signal outputting section outputs a drive signal for causing the element to perform the ink ejecting operation. The temperature sensor detects a temperature of the drive signal outputting section or in the vicinity thereof. The cap blocks an ejection opening of the nozzle. When printing is carried out on the medium by ejecting the ink from the nozzle, the controller performs, at least once between the moving-and-ejecting operation and the carrying operation, a first standby operation in which neither the moving-and-ejecting operation nor the carrying operation is performed for a predetermined time, if a detected temperature detected by the temperature sensor is higher than a first temperature, and performs, before performing the moving-and-ejecting operation, a second standby operation in which standby is performed for a time that is longer than the predetermined time by blocking the ejection opening of the nozzle with the cap, if the detected temperature is higher than a second temperature that is higher than the first temperature.

15 Claims, 23 Drawing Sheets standby at every moving-and-ejecting operation

| temperature | 75℃≦T<80℃ | 80℃≦T<85℃ |
|---|---|---|
| standby time | 1.0 second | 2.0 seconds |

FIG. 20A capping standby

| temperature | 85℃≦T<90℃ | 90℃≦T<95℃ | 95℃≦T<100℃ |
|---|---|---|---|
| standby time | 15.0 seconds | 30.0 seconds | 60.0 seconds |

FIG. 20B standby at every moving-and-ejecting operation

| temperature | 75℃≦T<85℃ | 85℃≦T<95℃ | 95℃≦T<100℃ |
|---|---|---|---|
| standby time | 1.0 second | 2.0 seconds | 5.0 seconds |

FIG. 21B

| standby operation | number of printed sheets |
|---|---|
| only capping standby | 30 sheets |
| capping standby + standby at every moving-and-ejecting operation | 45 sheets |

FIG. 24

PRINTING APPARATUS, PRINTING METHOD, STORAGE MEDIUM, AND PRINTING SYSTEM

CROSS-REFERENCE TO RELATED APPLICATIONS

The present application claims priority upon Japanese Patent Application No. 2005-061188 filed on Mar. 4, 2005, which is herein incorporated by reference.

BACKGROUND

1. Technical Field

The present invention relates to printing apparatuses, printing methods, storage media, and printing systems.

2. Related Art

Inkjet printers are known as printing apparatuses that carry out printing on media. The inkjet printers are provided with nozzles for ejecting ink, and carry out printing by ejecting ink toward media while carrying the media. The nozzles are each provided with an element for performing an ink ejecting operation for ejecting ink. The elements are constituted by piezoelectric elements, for example, and perform an ink ejecting operation when the elements are driven according to a drive signal that is input from the outside. The inkjet printers are provided with a drive signal outputting section by which the drive signal is output and supplied to the elements.

However, there are cases in which the temperature of the drive signal outputting section becomes high due to generation of heat when the inkjet printer performs a printing process in succession. When the drive signal outputting section enters this high-temperature state in this manner, there is a possibility that the elements are destroyed and thus drive signals are not properly output. When drive signals are not properly output from the drive signal outputting section in this manner, it may become impossible to perform the printing process.

Based on the above points, in order not to let the drive signal outputting section have high temperature, techniques have been proposed for cooling down the drive signal outputting section by halting the printing process every time the printing process of the inkjet printer ends on a predetermined area (see JP-A-2003-72058).

However, the above-described method, in which the drive signal outputting section is cooled down in this manner by halting the printing process every time the printing process of the inkjet printer ends on a predetermined area, has the following problem. When the temperature at the drive signal outputting section is very high, it is necessary that the printing process is halted for a long time every time the printing process of the inkjet printer ends on a predetermined area, and thus there is a possibility that a user mistakes that the inkjet printer is out of order. Furthermore, when the printing process is halted for a long time every time the printing process of the inkjet printer ends on a predetermined area, ink is solidified in the vicinity of ejection openings of the nozzles, and thus an ejection failure such as clogging in the nozzles may occur. Based on the above points, a very small drive signal is output from the drive signal outputting section to the elements such that the elements are vibrated to an extent that ink is not ejected from the nozzles, to prevent the ink from being solidified. However, when ink is prevented from being solidified in this manner, a drive signal is output from the drive signal outputting section, and thus the drive signal outputting section generates heat and the effect of lowering the temperature may be reduced.

SUMMARY

An advantage of some aspects of the present invention is that it is possible to enhance processing speed while achieving long-term stable performance by suppressing an increase in the temperature at an outputting section that outputs drive signals for performing ink ejecting operations.

An aspect of the invention is a printing apparatus including:

(A) a carry mechanism for carrying a medium;

(B) a nozzle for performing a moving-and-ejecting operation of ejecting ink toward the medium while moving relative to the medium during an intermission of a carrying operation performed by the carry mechanism;

(C) an element for performing an ink ejecting operation for causing the ink to be ejected from the nozzle;

(D) a drive signal outputting section for outputting a drive signal for causing the element to perform the ink ejecting operation;

(E) a temperature sensor for detecting a temperature of the drive signal outputting section or in the vicinity thereof;

(F) a cap for blocking an ejection opening of the nozzle; and (G) a controller that, when printing is carried out on the medium by ejecting the ink from the nozzle, is adapted to perform, at least once between the moving-and-ejecting operation and the carrying operation, a first standby operation in which neither the moving-and-ejecting operation nor the carrying operation is performed for a predetermined time, if a detected temperature detected by the temperature sensor is higher than a first temperature, and perform, before performing the moving-and-ejecting operation, a second standby operation in which standby is performed for a time that is longer than the predetermined time by blocking the ejection opening of the nozzle with the cap, if the detected temperature is higher than a second temperature that is higher than the first temperature.

Features and objects of the present invention other than the above will become clear by reading the description of the present specification with reference to the accompanying drawings.

BRIEF DESCRIPTION OF THE DRAWINGS

For a more complete understanding of the present invention and the advantages thereof, reference is now made to the following description taken in conjunction with the accompanying drawings.

FIG. 20A is an explanatory diagram of a standby time in "standby at every moving-and-ejecting operation".

FIG. 20B is an explanatory diagram of a standby time in "capping standby".

FIG. 21B is an explanatory diagram of a setting example of a standby time in accordance with the detected temperature.

FIG. 24 is a contrast diagram showing the number of printed sheets between this embodiment and a comparison example.

DESCRIPTION OF EXEMPLARY EMBODIMENTS

Figure 1:
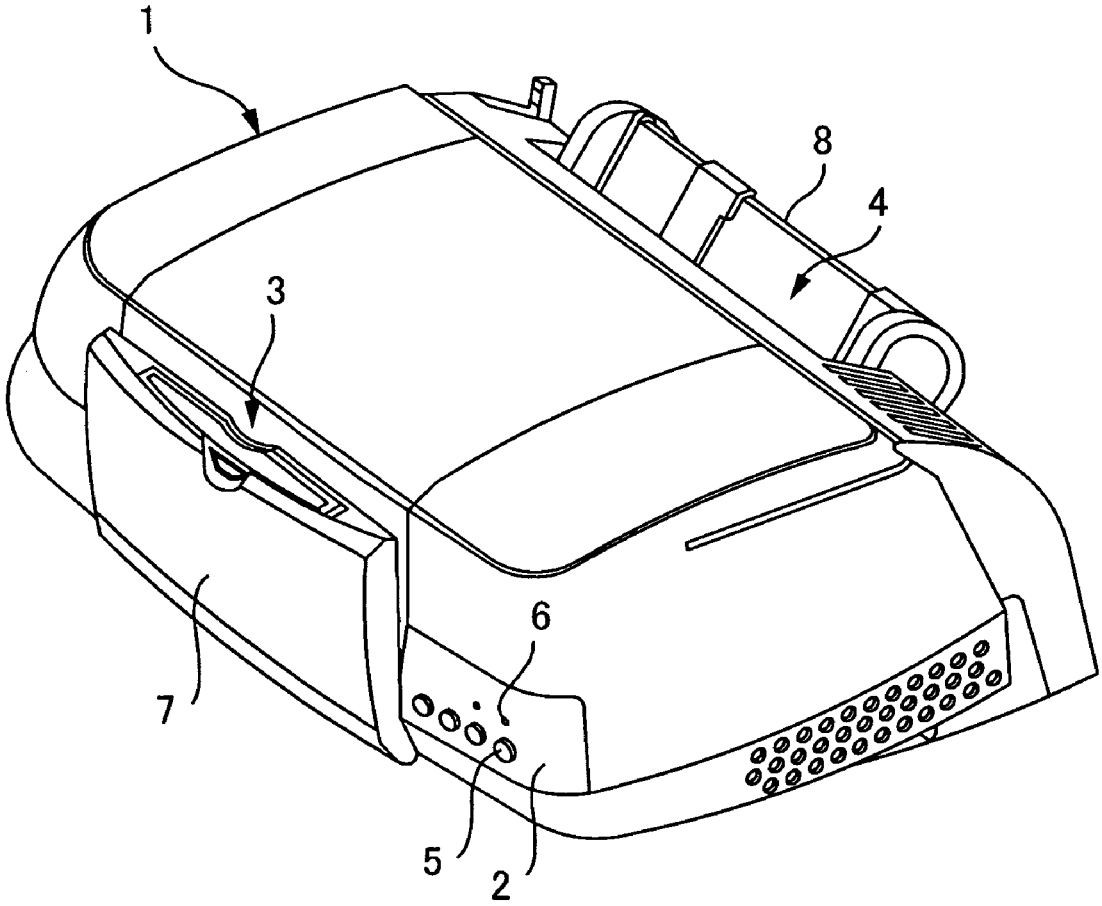
FIG. 1 is a perspective view of an embodiment of a printing apparatus according to the present invention.

At least the following matters will be made clear by the explanation in the present specification and the description of the accompanying drawings.

A printing apparatus includes:

(A) a carry mechanism for carrying a medium;

(B) a nozzle for performing a moving-and-ejecting operation of ejecting ink toward the medium while moving relative to the medium during an intermission of a carrying operation performed by the carry mechanism;

(C) an element for performing an ink ejecting operation for causing the ink to be ejected from the nozzle;

(D) a drive signal outputting section for outputting a drive signal for causing the element to perform the ink ejecting operation;

(E) a temperature sensor for detecting a temperature of the drive signal outputting section or in the vicinity thereof;

(F) a cap for blocking an ejection opening of the nozzle; and (G) a controller that, when printing is carried out on the medium by ejecting the ink from the nozzle, is adapted to perform, at least once between the moving-and-ejecting operation and the carrying operation, a first standby operation in which neither the moving-and-ejecting operation nor the carrying operation is performed for a predetermined time, if a detected temperature detected by the temperature sensor is higher than a first temperature, and perform, before performing the moving-and-ejecting operation, a second standby operation in which standby is performed for a time that is longer than the predetermined time by blocking the ejection opening of the nozzle with the cap, if the detected temperature is higher than a second temperature that is higher than the first temperature.

In this printing apparatus, when printing is carried out by ejecting ink from the nozzle, if the detected temperature of the temperature sensor is higher than the first temperature, then, between the moving-and-ejecting operation and the carrying operation, the first standby operation in which neither the moving-and-ejecting operation nor the carrying operation is performed for a predetermined time is performed at least once. Thus, the drive signal outputting section can be cooled down, so that it is possible to suppress an increase in the temperature at the drive signal outputting section. Furthermore, if the detected temperature is higher than the second temperature, which is higher than the first temperature, then, before performing the moving-and-ejecting operation, the second standby operation in which standby is performed for a time that is longer than the predetermined time by blocking the ejection opening of the nozzle with the cap is performed. Thus, it is possible to further suppress an increase in the temperature. Accordingly, an increase in the temperature can be sufficiently suppressed, so that a stable performance of the drive signal outputting section can be achieved for a long period of time. Furthermore, standby operations that are performed are made different for the first temperature and the second temperature in this manner. Thus, it is possible to enhance processing speed.

In this printing apparatus, the element may be constituted by a piezoelectric element. When a piezoelectric element performs an operation of ejecting ink in this manner, the application can be preferably performed.

In this printing apparatus, the drive signal outputting section may have a current amplifier circuit that is provided with a transistor. When the drive signal outputting section has a current amplifier circuit in this manner, the application can be preferably performed.

In this printing apparatus, the predetermined time may be set differently in accordance with the detected temperature of the temperature sensor. When the predetermined time is set differently in this manner, the standby time can be set in accordance with the detected temperature, and thus it is possible not to perform unnecessary standby.

In this printing apparatus, the time that is longer than the predetermined time may be set differently in accordance with the detected temperature of the temperature sensor. When the time that is longer than the predetermined time is set differently in this manner, the standby time can be set in accordance with the detected temperature, and thus it is possible not to perform unnecessary standby.

In this printing apparatus, the first standby operation may be performed every time the moving-and-ejecting operation is performed. When the first standby operation is performed in this manner, it is possible to further suppress an increase in the temperature at the drive signal outputting section.

In this printing apparatus, the second standby operation may be performed when the nozzle has moved to a predetermined position. When the second standby operation is performed in this manner when the nozzle has moved to a predetermined position, it is possible to perform standby with the ejection opening of the nozzle smoothly blocked with the cap.

In this printing apparatus, the second standby operation may be performed before printing is carried out on the medium. When the second standby operation is performed in this manner before printing is carried out on the medium, it is possible to suppress an increase in the temperature during printing.

In this printing apparatus, when printing is carried out on the medium by ejecting the ink from the nozzle, the controller may perform the first standby operation in addition to the second standby operation, if the detected temperature of the temperature sensor is higher than the second temperature. When the first standby operation is performed in addition to the second standby operation in this manner if the detected temperature is higher than the second temperature, it is possible to further suppress an increase in the temperature at the drive signal outputting section.

In this printing apparatus, the printing apparatus may further include a memory for storing a detected temperature detected with the temperature sensor when the first standby operation or the second standby operation is performed; and, when printing is carried out on the medium by ejecting the ink from the nozzle, the controller may compare the detected temperature of a previous time stored in the memory with a detected temperature of this time detected with the temperature sensor, and does not have to perform the second standby operation if the detected temperature of this time is not higher than the detected temperature of the previous time. When the second standby operation is not performed in this manner if the detected temperature of the present time detected with the temperature sensor is not higher than the detected temperature of the previous time stored in the memory, it is possible to enhance processing speed.

In this printing apparatus, in addition to the drive signal, the drive signal outputting section may output a different drive signal for vibrating the element to an extent that the element does not perform the ink ejecting operation. When this different drive signal can be output, it is possible to prevent an ejection failure such as clogging in the nozzle from being caused.

In this printing apparatus, the different drive signal maybe output when the first standby operation is being performed. When the different drive signal is output in this manner while the first standby operation is being performed, it is possible to prevent an ejection failure such as clogging in the nozzle from being caused when ink is not being ejected from the nozzle.

In this printing apparatus, the different drive signal does not have to be output when the second standby operation is being performed. When the different drive signal is not output in this manner while the second standby operation is being performed, it is possible to further suppress an increase in the temperature at the drive signal outputting section.

Further, a printing apparatus includes:

(A) a carry mechanism for carrying a medium;

(B) a nozzle for performing a moving-and-ejecting operation of ejecting ink toward the medium while moving relative to the medium during an intermission of a carrying operation performed by the carry mechanism;

(C) an element for performing an ink ejecting operation for causing the ink to be ejected from the nozzle;

(D) a drive signal outputting section for outputting a drive signal for causing the element to perform the ink ejecting operation;

(E) a temperature sensor for detecting a temperature of the drive signal outputting section or in the vicinity thereof;

(F) a cap for blocking an ejection opening of the nozzle; and (G) a controller that, when printing is carried out on the medium by ejecting the ink from the nozzle, is adapted to perform, at least once between the moving-and-ejecting operation and the carrying operation, a first standby operation in which neither the moving-and-ejecting operation nor the carrying operation is performed for a predetermined time, if a detected temperature detected by the temperature sensor is higher than a first temperature, and perform, before performing the moving-and-ejecting operation, a second standby operation in which standby is performed for a time that is longer than the predetermined time by blocking the ejection opening of the nozzle with the cap, if the detected temperature is higher than a second temperature that is higher than the first temperature, (H) wherein the element is constituted by a piezoelectric element;

(I) wherein the drive signal outputting section has a current amplifier circuit that is constituted by a transistor;

(J) wherein the predetermined time is set differently in accordance with the detected temperature of the temperature sensor;

(K) wherein the time that is longer than the predetermined time is set differently in accordance with the detected temperature of the temperature sensor;

(L) wherein the first standby operation is performed every time the moving-and-ejecting operation is performed;

(M) wherein the second standby operation is performed when the nozzle has moved to a predetermined position;

(N) wherein the second standby operation is performed before printing is carried out on the medium;

(O) wherein, when printing is carried out on the medium by ejecting the ink from the nozzle, the controller performs the first standby operation in addition to the second standby operation, if the detected temperature of the temperature sensor is higher than the second temperature;

(P) wherein the printing apparatus further includes a memory for storing a detected temperature detected with the temperature sensor when the first standby operation or the second standby operation is performed;

(Q) wherein, when printing is carried out on the medium by ejecting the ink from the nozzle, the controller compares the detected temperature of a previous time stored in the memory with a detected temperature of this time detected with the temperature sensor, and does not perform the second standby operation if the detected temperature of this time is not higher than the detected temperature of the previous time;

(R) wherein in addition to the drive signal, the drive signal outputting section outputs a different drive signal for vibrating the element to an extent that the element does not perform the ink ejecting operation;

(S) wherein the different drive signal is output when the first standby operation is being performed; and (T) wherein the different drive signal is not output when the second standby operation is being performed.

Further, a printing method includes:

when printing is carried out on a medium by performing a moving-and-ejecting operation of ejecting ink from a nozzle toward the medium while moving the nozzle relative to the medium during an intermission of a carrying operation of carrying the medium, acquiring a detected temperature from a temperature sensor that detects a temperature of a drive signal outputting section for outputting a drive signal for causing an element to perform an ink ejecting operation for causing the ink to be ejected from the nozzle, or a temperature in the vicinity of the drive signal outputting section; and performing, at least once between the moving-and-ejecting operation and the carrying operation, a first standby operation in which neither the moving-and-ejecting operation nor the carrying operation is performed for a predetermined time, if the detected temperature of the temperature sensor is higher than a first temperature, and performing, before performing the moving-and-ejecting operation, a second standby operation in which standby is performed for a time that is longer than the predetermined time by blocking the ejection opening of the nozzle with the cap, if the detected temperature is higher than a second temperature that is higher than the first temperature.

Further, provided is a storage medium having a program stored thereon, the program being executed on a printing apparatus including:

(A) a carry mechanism for carrying a medium;

(B) a nozzle for performing a moving-and-ejecting operation of ejecting ink toward the medium while moving relative to the medium during an intermission of a carrying operation performed by the carry mechanism;

(C) an element for performing an ink ejecting operation for causing the ink to be ejected from the nozzle;

(D) a drive signal outputting section for outputting a drive signal for causing the element to perform the ink ejecting operation;

(E) a temperature sensor for detecting a temperature of the drive signal outputting section or in the vicinity thereof; and (F) a cap for blocking an ejection opening of the nozzle, the program causing the printing apparatus to execute, when printing is carried out on the medium by ejecting the ink from the nozzle:

a step of acquiring a detected temperature from the temperature sensor; and a step of performing, at least once between the moving-and-ejecting operation and the carrying operation, a first standby operation in which neither the moving-and-ejecting operation nor the carrying operation is performed for a predetermined time, if the detected temperature is higher than a first temperature, and performing, before performing the moving-and-ejecting operation, a second standby operation in which standby is performed for a time that is longer than the predetermined time by blocking the ejection opening of the nozzle with the cap, if the detected temperature is higher than a second temperature that is higher than the first temperature.

Further, a printing system includes:

a computer; and a printing apparatus that is connectable to the computer and that includes:

a carry mechanism for carrying a medium, a nozzle for performing a moving-and-ejecting operation of ejecting ink toward the medium while moving relative to the medium during an intermission of a carrying operation performed by the carry mechanism, an element for performing an ink ejecting operation for causing the ink to be ejected from the nozzle, a drive signal outputting section for outputting a drive signal for causing the element to perform the ink ejecting operation, a temperature sensor for detecting a temperature of the drive signal outputting section or in the vicinity thereof, a cap for blocking an ejection opening of the nozzle, and a controller that, when printing is carried out on the medium by ejecting the ink from the nozzle, is adapted to perform, at least once between the moving-and-ejecting operation and the carrying operation, a first standby operation in which neither the moving-and-ejecting operation nor the carrying operation is performed for a predetermined time, if a detected temperature detected by the temperature sensor is higher than a first temperature, and perform, before performing the moving-and-ejecting operation, a second standby operation in which standby is performed for a time that is longer than the predetermined time by blocking the ejection opening of the nozzle with the cap, if the detected temperature is higher than a second temperature that is higher than the first temperature.

===Outline of Printing Apparatus===

Figure 2:
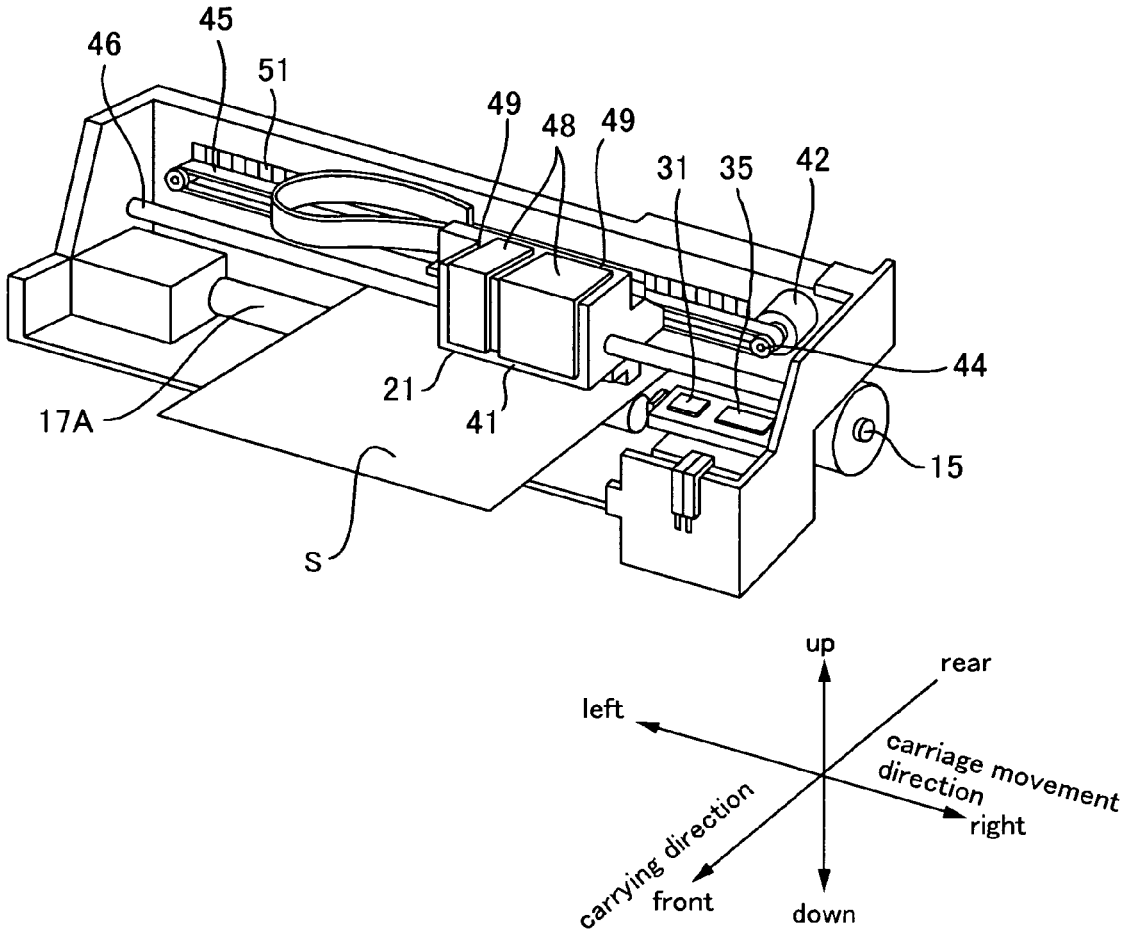
FIG. 2 is a perspective view illustrating the internal configuration of the printing apparatus.
Figure 3:
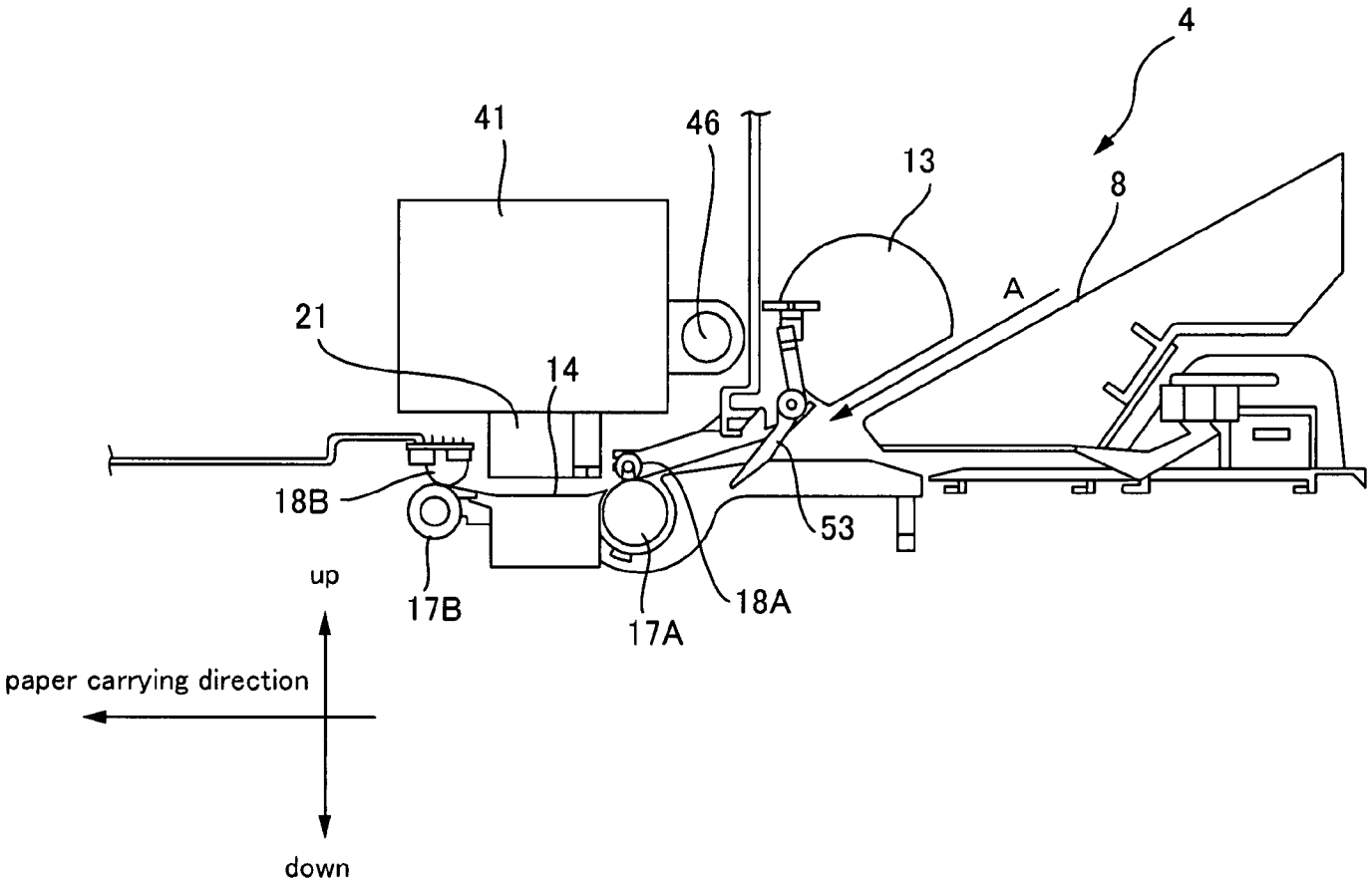
FIG. 3 is a cross-sectional view showing a carrying section of the printing apparatus.
Figure 4:
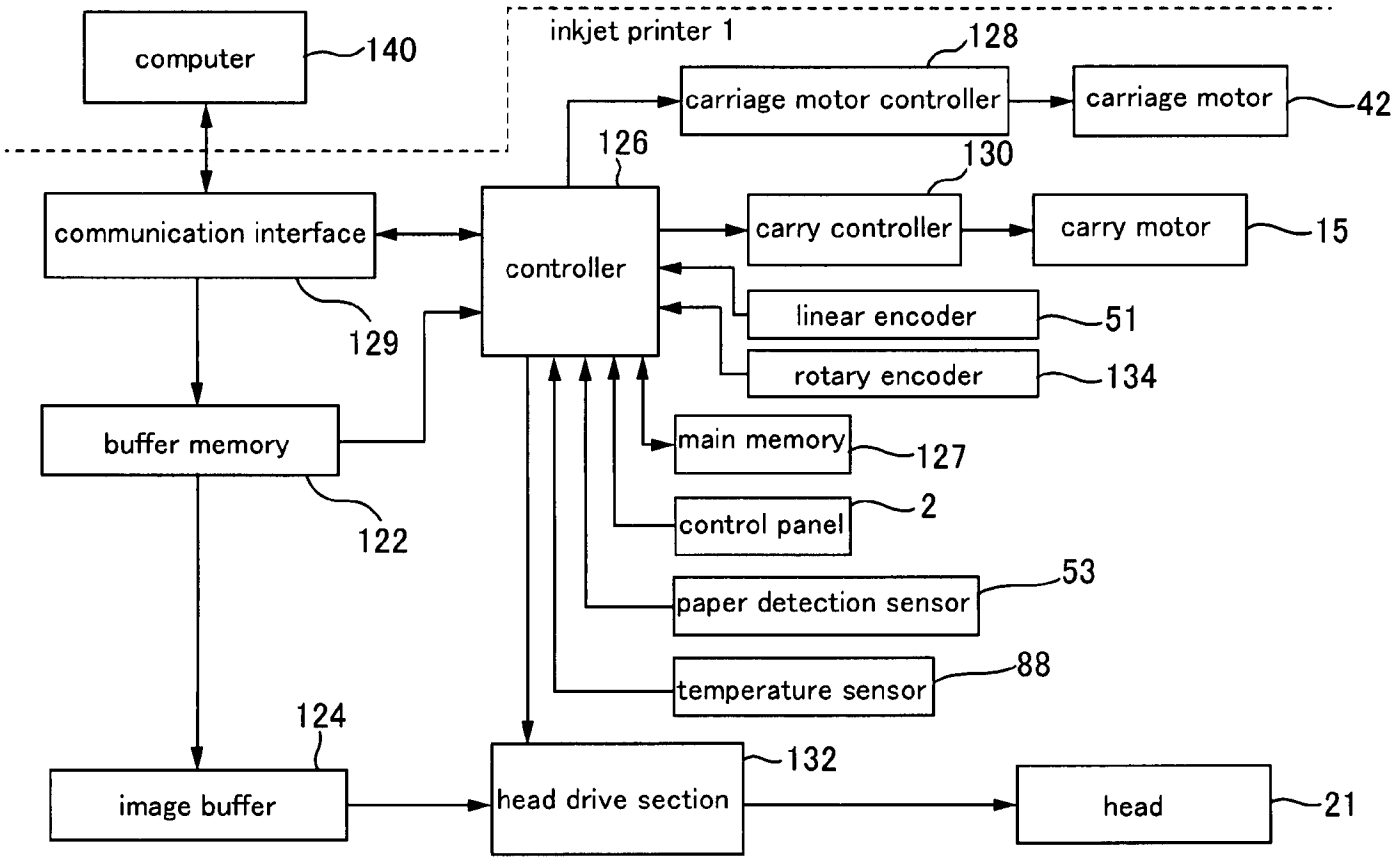
FIG. 4 is a block diagram showing the system configuration of the printing apparatus.

An embodiment of a printing apparatus according to the present invention is described by taking an inkjet printer 1 as an example. FIGS. 1 to 4 show the inkjet printer 1. FIG. 1 shows the appearance of the inkjet printer 1. FIG. 2 shows the internal configuration of the inkjet printer 1. FIG. 3 shows the configuration of a carrying section of the inkjet printer 1. FIG. 4 shows the system configuration of the inkjet printer 1.

As shown in FIG. 1, the inkjet printer 1 is provided with a structure in which a medium such as print paper that is supplied from the rear face is discharged from the front face. The front face portion is provided with a control panel 2 and a paper discharge section 3, and the rear face portion is provided with a paper supply section 4. The control panel 2 is provided with various types of control buttons 5 and display lamps 6. Furthermore, the paper discharge section 3 is provided with a paper discharge tray 7 that blocks the paper discharge opening when the inkjet printer is not used. The paper supply section 4 is provided with a paper supply tray 8 for holding a medium such as cut paper.

As shown in FIG. 2, the internal portion of the inkjet printer 1 is provided with a carriage 41. The carriage 41 is disposed such that it can move relatively in the left-and-right direction. A carriage motor 42, a pulley 44, a timing belt 45, and a guide rail 46 are arranged in the vicinity of the carriage 41. The carriage motor 42 is constituted by a DC motor or the like and functions as a driving force for moving the carriage 41 relatively in the left-and-right direction (hereinafter, also referred to as "carriage movement direction"). The timing belt 45 is connected via the pulley 44 to the carriage motor 42, and a part of it is also connected to the carriage 41, such that the carriage 41 is moved relatively in the carriage movement direction (left-and-right direction) with the rotational force of the carriage motor 42. The guide rail 46 guides the carriage 41 in the carriage movement direction (left-and-right direction).

In addition to the above, a linear encoder 51 for detecting the position of the carriage 41, a carry roller 17A for carrying a medium S in the direction (rear-to-front direction in the drawing, and hereinafter, also referred to as "carrying direction") that intersects with the movement direction of the carriage 41, and a carry motor 15 for rotatively driving the carry roller 17A are arranged in the vicinity of the carriage 41.

On the other hand, the carriage 41 is provided with ink cartridges 48 that contain various types of ink and a head 21 that carries out printing on the medium S. The ink cartridges 48 contain ink of various colors such as yellow (Y), magenta (M), cyan (C), and black (K), and are removably mounted in a cartridge mounting section 49 provided in the carriage 41. Furthermore, in this embodiment, the head 21 carries out printing by ejecting ink onto the medium S. For this reason, the head 21 is provided with a large number of nozzles for ejecting ink. A detailed description of the nozzles is given later.

In addition to the above, the internal portion of the inkjet printer 1 is provided with, for example, a pump device 31 for pumping ink from the nozzles such that clogging in the nozzles of the head 21 is eliminated, and a capping device 35 for capping the nozzles of the head 21 when printing is not being carried out (when being on standby, for example) such that clogging in the nozzles of the head 21 is prevented. It should be noted that the capping device 35 corresponds to "a cap" for blocking ejection openings of the nozzles provided in the head 21. A detailed description of the capping device 35 is given later.

The following is a description concerning a carrying section ("carry mechanism") of the inkjet printer 1. As shown in FIG. 3, the carrying section is provided with a paper supply roller 13, a paper detection sensor 53, the carry roller 17A, a paper discharge roller 17B, a platen 14, and free rollers 18A and 18B.

The medium S to be printed is set at the paper supply tray 8. The medium S that has been set at the paper supply tray 8 is carried along the arrow A in the drawing by the paper supply roller 13 that has a substantially D-shaped cross-section, and is sent into the internal portion of the inkjet printer 1. The medium S that has been sent into the internal portion of the inkjet printer 1 is brought into contact with the paper detection sensor 53. This paper detection sensor 53 is positioned between the paper supply roller 13 and the carry roller 17A, and it detects the medium S that has been supplied by the paper supply roller 13.

The medium S that has been detected by the paper detection sensor 53 is successively carried by the carry roller 17A to the platen 14 where printing is carried out. The free roller 18A is disposed at the position opposed to the carry roller 17A. The medium S is smoothly carried by being pinched between the free roller 18A and the carry roller 17A.

The medium S that has been sent onto the platen 14 is successively printed with ink ejected from the head 21. The platen 14 is disposed so as to be opposed to the head 21 and supports the medium S to be printed from below.

The medium S on which printing has been carried out is successively discharged by the paper discharge roller 17B to the outside of the printer. The paper discharge roller 17B is driven in synchronization with the carry motor 15, and discharges the medium S to the outside of the printer by holding the medium S between the paper discharge roller 17B and the free roller 18B that is disposed so as to be opposed to this paper discharge roller 17B.

<System Configuration>

The following is a description concerning the system configuration of the inkjet printer 1. As shown in FIG. 4, the inkjet printer 1 is provided with a buffer memory 122, an image buffer 124, a controller 126, a main memory 127, a communication interface 129, a carriage motor controller 128, a carry controller 130, and a head drive section 132.

The communication interface 129 is used by the inkjet printer 1 to exchange data with an external computer 140 such as a personal computer. The communication interface 129 is connected to the external computer 140 such that wired or wireless communications are possible, and receives various types of data such as print data transmitted from the computer 140.

The various types of data such as print data received by the communication interface 129 is temporarily stored in the buffer memory 122. Furthermore, the print data stored in the buffer memory is sequentially stored in the image buffer 124. The print data stored in the image buffer 124 is sequentially sent to the head drive section 132. Furthermore, the main memory 127 is constituted by a ROM, a RAM, or an EEPROM, for example. Various programs for controlling the inkjet printer 1 and various types of setting data, for example, are stored in the main memory 127.

The controller 126 reads out control programs and various types of setting data from the main memory 127 and performs overall control of the inkjet printer 1 in accordance with the control programs and the various types of setting data. Furthermore, detection signals from various sensors such as a rotary encoder 134, the linear encoder 51, and the paper detection sensor 53 are input to the controller 126.

When various types of data such as print data that has been sent from the external computer 140 is received by the communication interface 129 and is stored in the buffer memory 122, the controller 126 reads out necessary information from among the stored data from the buffer memory 122. Based on the information that is read out, the controller 126 controls each of the carriage motor controller 128, the carry controller 130, and the head drive section 132, for example, in accordance with the control programs while referencing output from the linear encoder 51 and the rotary encoder 134.

The carriage motor controller 128 controls the drive such as the rotation direction, the rotation number, and the torque of the carriage motor 42 in accordance with instructions from the controller 126. The carry controller 130 controls the drive of, for example, the carry motor 15 for rotatively driving the carry roller 17A in accordance with instructions from the controller 126.

The head drive section 132 controls the drive of the color nozzles provided in the head 21 in accordance with instructions from the controller 126 and based on print data stored in the image buffer 124.

In addition to the above, the inkjet printer 1 according to this embodiment is provided with a temperature sensor 88. A detailed description of the temperature sensor 88 is given later.

<Head>

Figure 5:
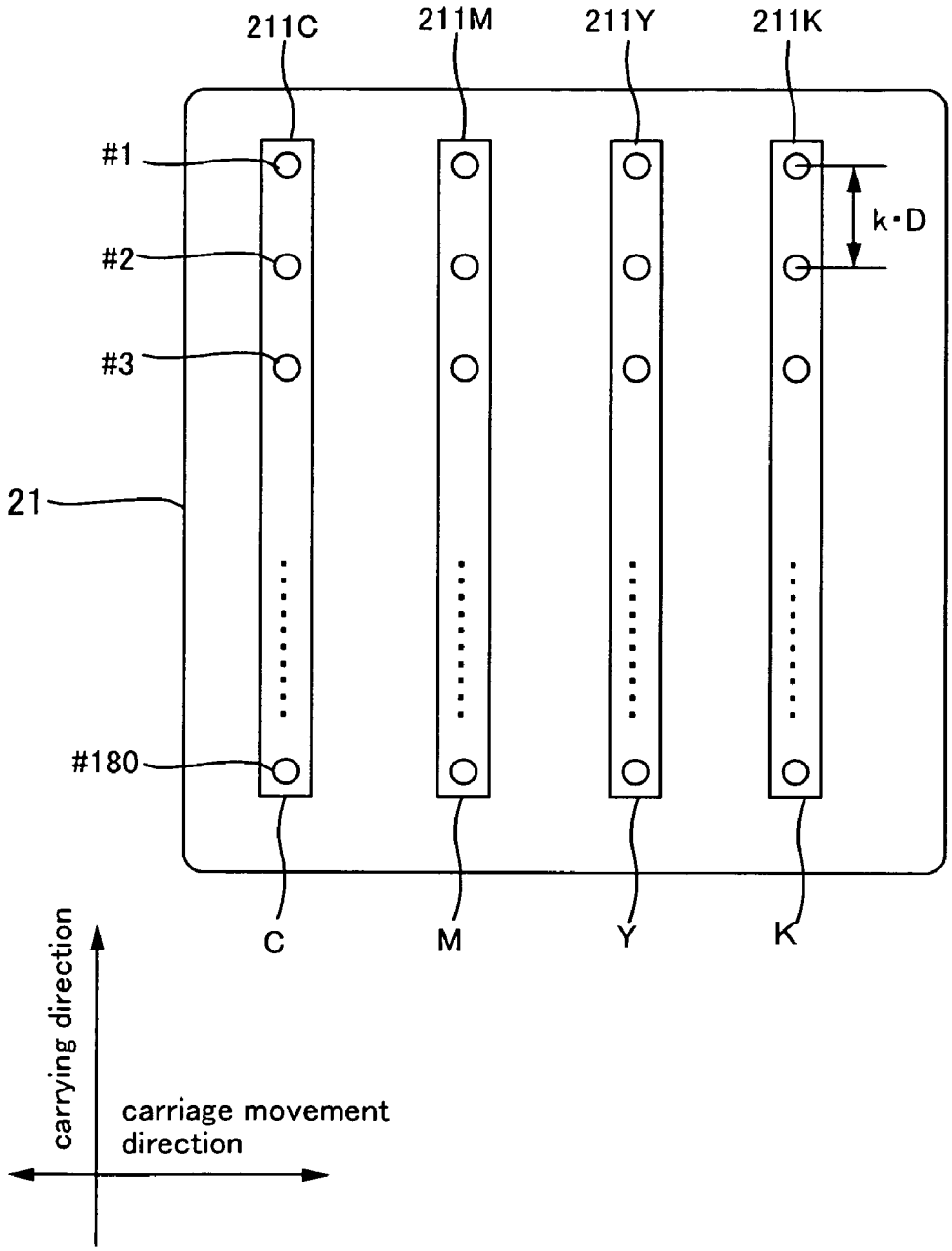
FIG. 5 is an explanatory diagram showing the arrangement of nozzles of a head.

FIG. 5 is a diagram showing the arrangement of the ink nozzles provided in the bottom face portion of the head 21. As shown in FIG. 5, the bottom face portion of the head 21 is provided with nozzle rows—that is, a cyan nozzle row 211C, a magenta nozzle row 211M, a yellow nozzle row 211Y, and a black nozzle row 211K—for each of the colors yellow (Y), magenta (M), cyan (C), and black (K). Each nozzle row is constituted by a plurality of nozzles #1 to #180.

The nozzles #1 to #180 in each of the nozzle rows 211C, 211M, 211Y, and 211K are arranged in one straight line with a spacing interposed therebetween in a predetermined direction (carrying direction of the medium S in this embodiment). Each spacing between the nozzles #1 to #180 (nozzle spacing) is set to "kD". Here, D is the minimum dot pitch in the carrying direction (that is, the spacing between dots formed on the medium S at the highest resolution). Also, k is an integer of 1 or larger. For example, if the nozzle pitch is 120 dpi (1/120 inch), and the dot pitch in the carrying direction is 360 dpi (1/360), then k=3. The nozzle rows 211C, 211M, 211Y, and 211K are arranged in parallel to each other with a spacing interposed therebetween in the movement direction (scanning direction) of the head 21. The nozzles #1 to #180 are provided with piezo elements (not shown) as drive elements for ejecting ink droplets. It should be noted that the piezo elements correspond to "elements for performing an ink ejecting operation" herein.

When a voltage of a predetermined duration is applied between electrodes provided at both ends of the piezo element, the piezo element is expanded for the duration of voltage application and deforms a lateral wall of the ink channel. Accordingly, the volume of the ink channel is constricted in accordance with the expansion of the piezo element, and ink corresponding to this amount of constriction becomes an ink droplet, which is ejected from one of the nozzles #1 to #180 of the color nozzle rows 211C, 211M, 211Y, and 211K.

===Drive Circuit of Head===

Figure 6:
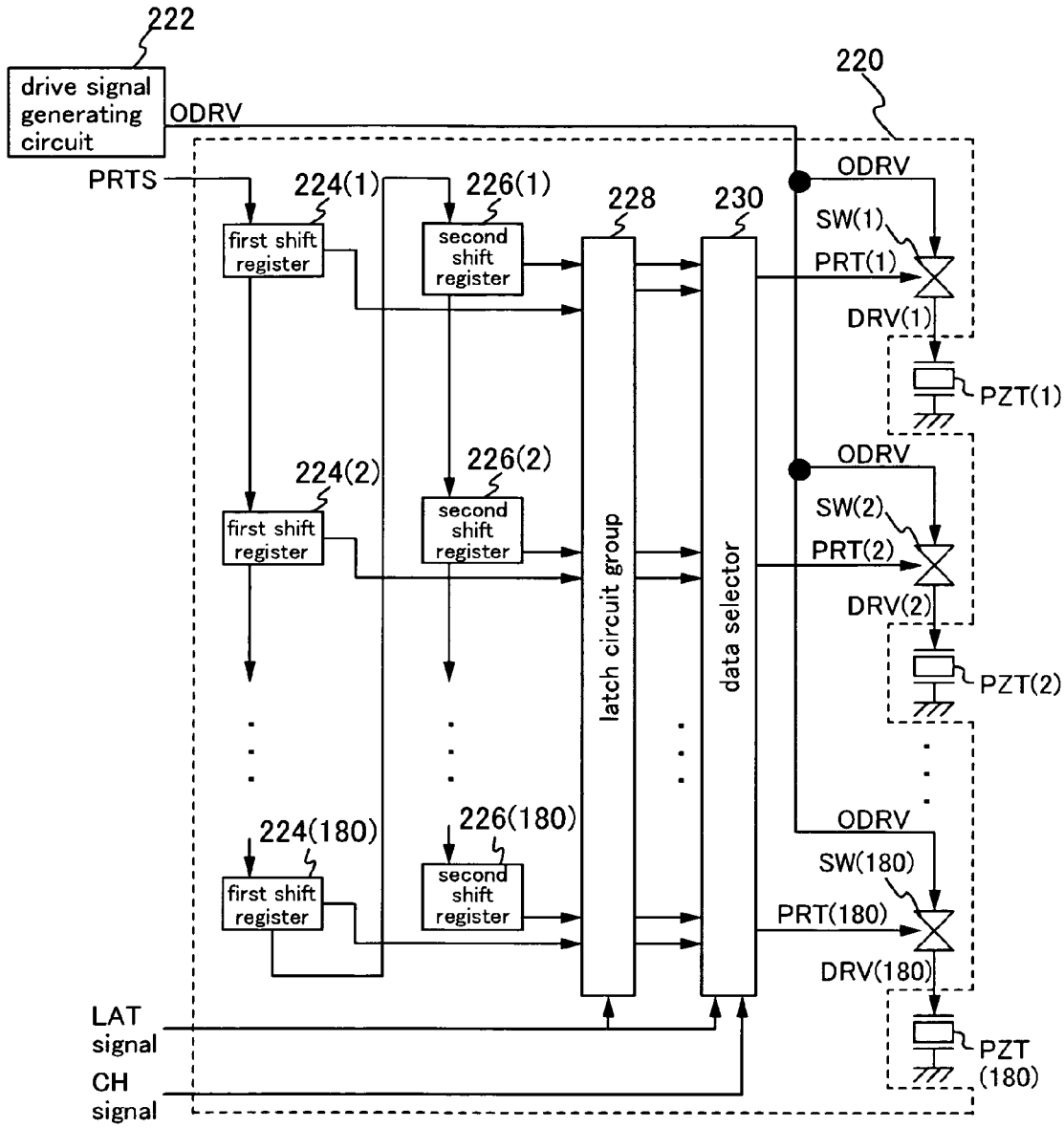
FIG. 6 is a diagram illustrating an example of a drive circuit of the head.
Figure 7:
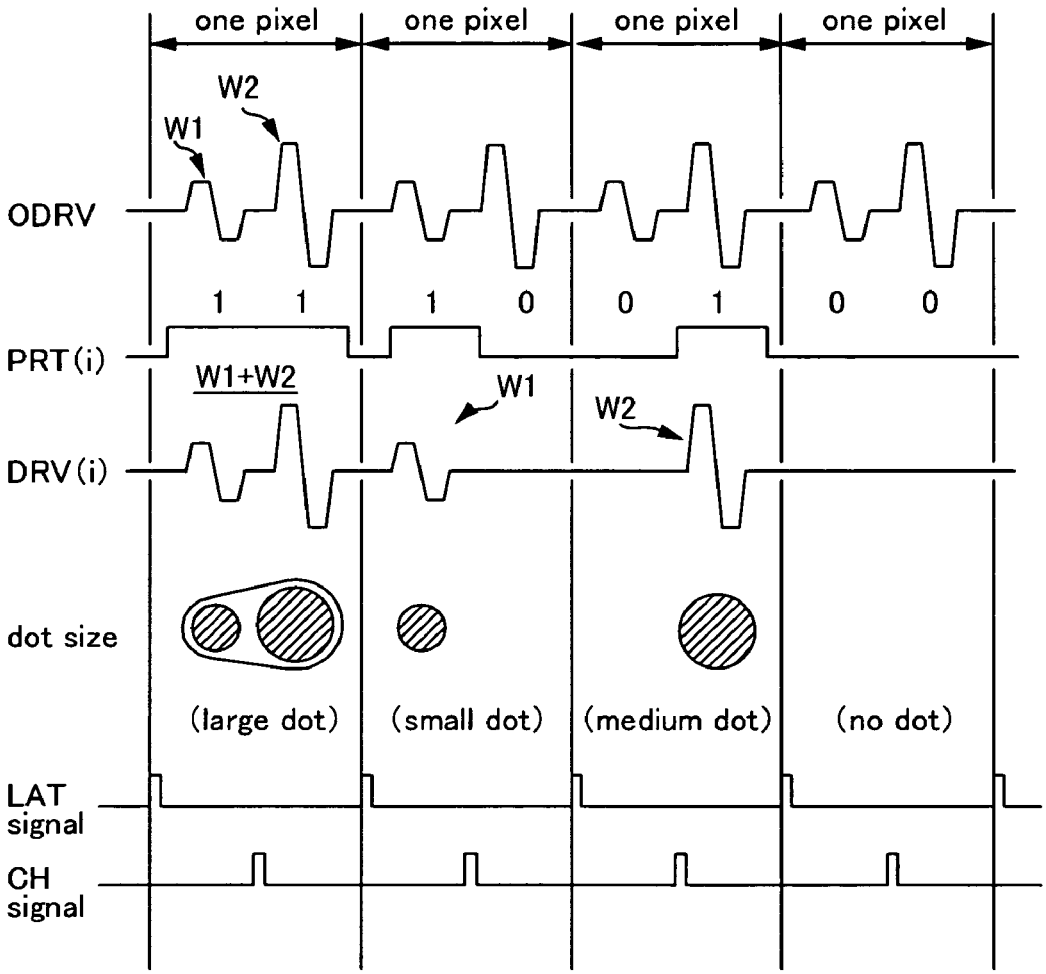
FIG. 7 is a timing chart of signals.

FIG. 6 shows an example of a drive circuit 220 of the head 21. Furthermore, FIG. 7 is a timing chart illustrating the signals of the drive circuit 220.

The drive circuit 220 is provided for causing ink to be ejected from the nozzles #1 to #180 provided in the head 21, and drives 180 piezo elements PZT(1) to (180) provided in correspondence with the nozzles #1 to #180. The piezo elements PZT(1) to (180) are driven based on a print signal PRTS that is input to this drive circuit 220. In FIG. 6, the numbers in parentheses indicated at the end of the signals or components denote the nozzle numbers 1 to 180 corresponding to the signals or components.

In this embodiment, this drive circuit 220 is provided separately for each of the nozzle rows 211Y, 211M, 211C, and 211K that are provided in the head 21. That is to say, four nozzle drive circuits 220 are provided, respectively, in correspondence with the yellow ink nozzle row 211Y, the magenta ink nozzle row 211M, the cyan ink nozzle row 211C and the black ink nozzle row 211K.

The configuration of the drive circuit 220 is described. As shown in FIG. 6, the drive circuit 220 is provided with a drive signal generating circuit 222 for generating a drive signal ODRV, 180 first shift registers 224(1) to (180), 180 second shift registers 226(1) to (180), a latch circuit group 228, a data selector 230, and 180 switches SW(1) to (180). It should be noted that the drive signal generating circuit 222 corresponds to "a drive signal outputting section" herein. Furthermore, the drive signal ODRV corresponds to "a drive signal for causing an ink ejecting operation to be performed" herein.

The drive signal generating circuit 222 generates a drive signal ODRV that is shared by the nozzles #1 to #180. The drive signal ODRV is a signal for driving the piezo elements PZT(l) to (180) provided in correspondence with the nozzles #1 to #180. As shown in FIG. 7, the drive signal ODRV is a signal that has a plurality of pulses, that is, a first pulse W1 and a second pulse W2 herein, in a main-scanning period for one pixel (i.e., within a time during which the carriage 41 moves across the spacing for one pixel). In the drive signal ODRV, the plurality of pulses (first pulse W1 and second pulse W2) are repeatedly generated in a predetermined period. The drive signal ODRV generated by the drive signal generating circuit 222 is output toward the switches SW(l) to (180).

On the other hand, the print signal PRTS (see FIG. 6) is a data signal including 180 sets of 2-bit data for driving the piezo elements (1) to (180), and is a signal that indicates, for example, whether or not ink is to be ejected from the nozzles #1 to #180 and the size of ink that is to be ejected. The print signal PRTS is serially transmitted to the drive circuit 220, and is input to the 180 first shift registers 224(1) to (180). Next, the print signal PRTS is input to the second shift registers 226(1) to (180). Herein, data of the first bit, among the 180 sets of 2-bit data, is input to each of the first shift registers 224 (1) to (180). Furthermore, data of the second bit, among the 180 sets of 2-bit data, is input to each of the second shift registers 226(1) to (180).

The latch circuit group 228 latches data stored in the first shift registers 224(1) to (180) and the second shift registers 226(1) to (180), and obtains the data as signals indicating "0 (low)" or "1 (high)". Then, the signals extracted based on data stored in the first shift registers 224 (1) to (180) and the second shift registers 226(1) to (180) are output by the latch circuit group 228 to the data selector 230. The latch timing of the latch circuit group 228 is controlled based on a latch signal (LAT) that is input to this latch circuit group 228. More specifically, when pulses as shown in FIG. 7 are input to the latch circuit group 228 as a latch signal (LAT), the latch circuit group 228 latches data stored in the first shift registers 224(1) to (180) and the second shift registers 226(1) to (180). The latch circuit group 228 latches data every time pulses are input as a latch signal (LAT).

On the other hand, the data selector 230 selects signals corresponding to either one of the first shift registers 224 (1) to (180) and the second shift registers 226(1) to (180), from among the signals (signals indicating "0 (low)" or "1 (high)") that are output from the latch circuit group 228, and outputs the signals as print signals PRT(1) to (180) respectively to the switches SW(1) to (180). The signals selected by the data selector 230 are switched according to both the latch signal (LAT signal) and a change signal (CH signal) that are input to this data selector 230.

Herein, when pulses as shown in FIG. 7 are input to the data selector 230 as a latch signal (LAT signal), the data selector 230 selects signals corresponding to data stored in the second shift registers 226(1) to (180), and outputs these signals as print signals PRT(1) to (180) respectively to the switches SW(1) to (180). Furthermore, when pulses as shown in FIG. 7 are input to the data selector 230 as a change signal (CH signal), the data selector 230 switches signals to be selected from signals corresponding to data stored in the second shift registers 226(1) to (180) to signals corresponding to data stored in the first shift registers 224 (1) to (180), and outputs these signals as print signals PRT(1) to (180) respectively to the switches SW(1) to (180). Then, when pulses are input again as a latch signal (LAT signal), the data selector 230 switches signals to be selected from signals corresponding to data stored in the first shift registers 224(1) to (180) to signals corresponding to data stored in the second shift registers 226(1) to (180), and outputs these signals as print signals PRT(1) to (180) respectively to the switches SW(1) to (180).

Herein, as shown in FIG. 7, in a latch signal (LAT signal), a pulse is generated at a period for one pixel unit. Furthermore, as shown in FIG. 7, in a change signal (CH signal), a pulse is generated at a timing that is at the middle of each period for one pixel. Accordingly, 2-bit data corresponding to one pixel is serially transmitted to the switches SW(1) to (180). More specifically, 2-bit data such as "00", "01", "10", and "11" is input to the switches SW(1) to (180) as the print signals PRT(l) to (180) in every period for one pixel.

The switches SW(l) to (180) determine whether or not to let the drive signal ODRV input from the drive signal generating circuit 222 pass through, based on the print signals PRT(1) to (180) output from the data selector 230, that is, 2-bit data such as "00", "01", "10", and "11". More specifically, if the level of a print signal PRT(i) is "1 (high)", then the drive pulse (first pulse W1 or second pulse W2) corresponding to the drive signal ODRV is led to pass through to be a real drive signal DRV(i). On the other hand, if the level of a print signal PRT(i)

is "0 (low)", then the switches SW(1) to (180) block the drive pulse (first pulse W1 or second pulse W2) corresponding to the drive signal ODRV.

Accordingly, as shown in FIG. 7, the real drive signal DRV(i) that is input from switches SW(l) to (180) to the piezo elements PZT(l) to (180) varies in accordance with the print signals PRT(1) to (180) input from the data selector 230 to the switches SW(1) to (180), that is, 2-bit data such as "00", "01", "10", and "11".

Herein, if "10" is input to the switch SW(i) as the print signal PRT(i), then only the first pulse W1 passes through the switch SW(i) and is input to the piezo element PZT (i). The piezo element PZT (i) is driven with this first pulse W1, and an ink droplet of a small size (hereinafter, also referred to as "a small ink droplet") is ejected from the nozzle. Accordingly, a dot of a small size (small dot) is formed on the medium S.

Furthermore, if "01" is input to the switch SW(i) as the print signal PRT(i), then only the second pulse W2 passes through the switch SW(i) and is input to the piezo element PZT(i). The piezo element PZT(i) is driven with this second pulse W2, and an ink droplet of a size that is larger than the previous small size (hereinafter, also referred to as "a medium ink droplet") is ejected from the nozzle. Accordingly, a dot of a medium size (medium dot) is formed on the medium S.

Furthermore, if "11" is input to the switch SW (i) as the print signal PRT (i), then both the first pulse W1 and the second pulse W2 pass through the switch SW(i) and are input to the piezo element PZT(i). The piezo element PZT(i) is driven with the first pulse W1 and the second pulse W2, and a small ink droplet and a medium ink droplet are ejected from the nozzle. The small ink droplet and the medium ink droplet are ejected in succession with a predetermined time interval. Accordingly, a small dot formed with the small ink droplet and a medium dot formed with the medium ink droplet are formed on the medium S. The small dot and the medium dot form a dot (large dot) of a size that looks large on the medium S.

Furthermore, if "00" is input to the switch SW(i) as the print signal PRT(i), then neither the first pulse W1 nor the second pulse W2 passes through the switch SW (i), and no drive pulse is input to the piezo element PZT(i). Accordingly, no ink droplet is ejected from the nozzle, and no dot is formed on the medium S.

===Ink Ejection Mechanism===

Figure 8:
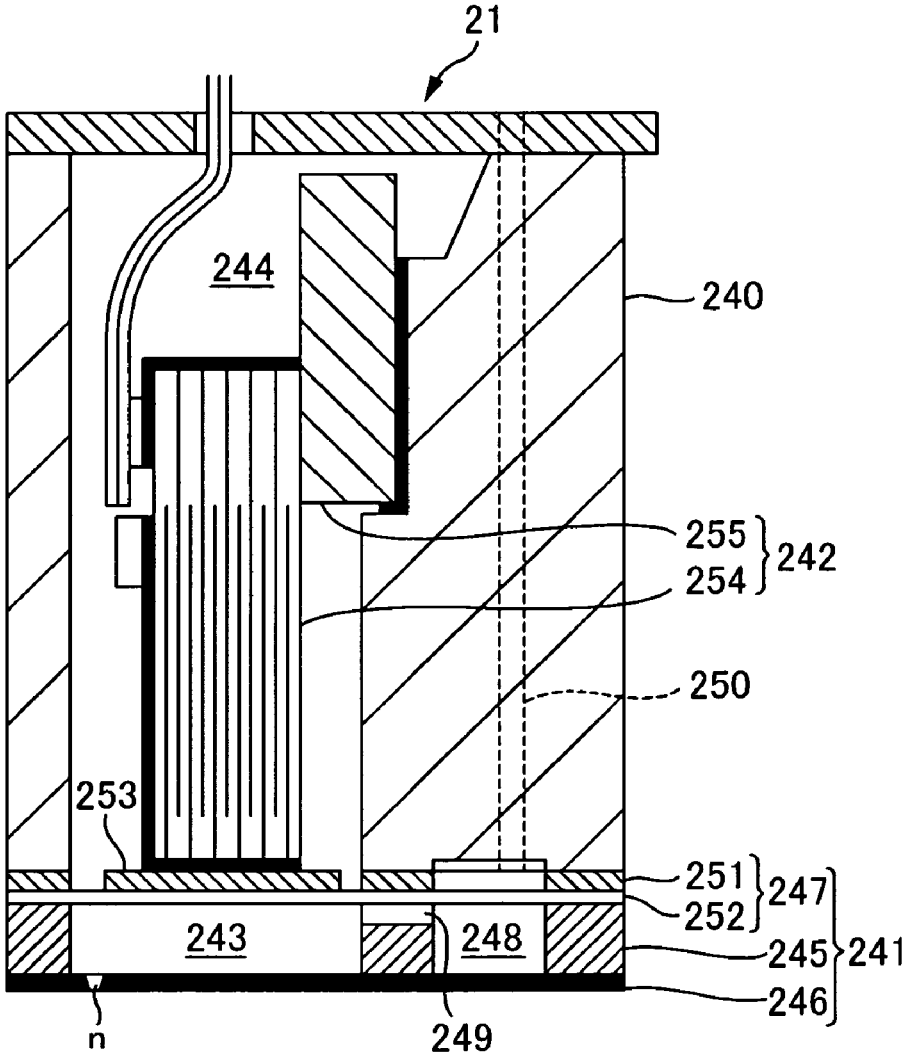
FIG. 8 is an explanatory diagram of an ink ejection mechanism.

FIG. 8 shows an example of an ink ejection mechanism inside the head 21 in detail. As shown in FIG. 8, the head 21 is provided with a box-shaped case 240 and a channel unit 241. The channel unit 241 is bonded to the front end portion of the box-shaped case 240. Furthermore, a vibrator unit 242 is disposed in the internal portion of the box-shaped case 240. The vibrator unit 242 causes the pressure inside a pressure compartment 243 inside the channel unit 241 to fluctuate, so that ink in the shape of droplets (also referred to as ink droplets) is ejected from nozzles n (#1 to #180).

The case 240 is made of a resin material, for example, and the internal portion thereof is provided with an accommodating compartment 244 for accommodating the vibrator unit 242. The accommodating compartment 244 is defined from an opening provided on the side of a face bonded to the channel unit 241 up to an opposite face.

The channel unit 241 is formed by bonding a nozzle plate 246 to one face of a channel forming substrate 245 and a vibration plate 247 to the other face. Herein, the channel forming substrate 245 is made of silicon wafer, for example. The channel forming substrate 245 is etched and thus partitioned in a predetermined pattern, wherein a plurality of pressure compartments 243 that are in communication with the respective nozzles n (#1 to #180), a common ink compartment 248, a plurality of ink supply paths 249 through which the common ink compartment 248 is in communication with the pressure compartments 243, for example, are formed as appropriate. Herein, the common ink compartment 248 is provided with a connection port that is connected to an ink supply tube 250, and ink contained in the ink cartridge 48 is supplied via the ink supply tube 250 to the common ink compartment 248. Furthermore, the plurality of nozzles n are provided in the nozzle plate 246 at a predetermined pitch.

The vibration plate 247 has a double-layer structure in which an elastic film 252 such as a PPS film is layered on a stainless plate 251. The portion corresponding to each of the pressure compartments 243 is etched in the shape of a ring on the side of the stainless plate 251, and an island section 253 is formed inside the ring.

The vibrator unit 242 is constituted by piezo elements 254 (PZT (1) to (180)) that are one type of pressure generating element, and a fix member 255 to which the piezo elements 254 are bonded. The piezo elements 254 are formed in the shape of comb teeth by forming slit sections in one piezoelement plate, in which piezoelectric members and electrode layers are alternately layered, at a predetermined pitch corresponding to the pressure components 243 in the channel unit 241. Furthermore, the fix member 255 is fixed on the base end portion of the vibrator in the shape of comb teeth. The vibrator unit 242 is inserted into the accommodating compartment 244 in the case 240 in such a manner that the front ends of the piezo elements 254 are exposed from the opening, and is accommodated by fixing the fix member 255 onto the internal wall of the accommodating compartment 244. In this accommodation state, the front ends of the piezo elements 254 abut against and are bonded to the corresponding island sections 253 on the vibration plate 247.

When a potential difference is applied to the opposed electrodes, the piezo elements 254 are expanded or constricted in the longitudinal direction of the element that is perpendicular to the layered direction, and displace the elastic film 252 partitioning the pressure compartments 243. More specifically, in this head 21, when the piezo elements 254 are expanded in the longitudinal direction of the element, the island sections 253 are pressed toward the nozzle plate 246, and thus the elastic film 252 in the vicinity of the island sections is deformed, so that the pressure compartments 243 are constricted. Furthermore, when the piezo elements 254 are constricted in the longitudinal direction of the element, the elastic film 252 is displaced and thus the pressure compartments 243 are expanded. In accordance with the expansion and constriction of the pressure compartments 243, the pressure of ink that is filled in the pressure compartments 243 fluctuates, and ink droplets are ejected from the nozzles n (#1 to #180) of the channel unit 241.

===Printing Operation===

Figure 9:
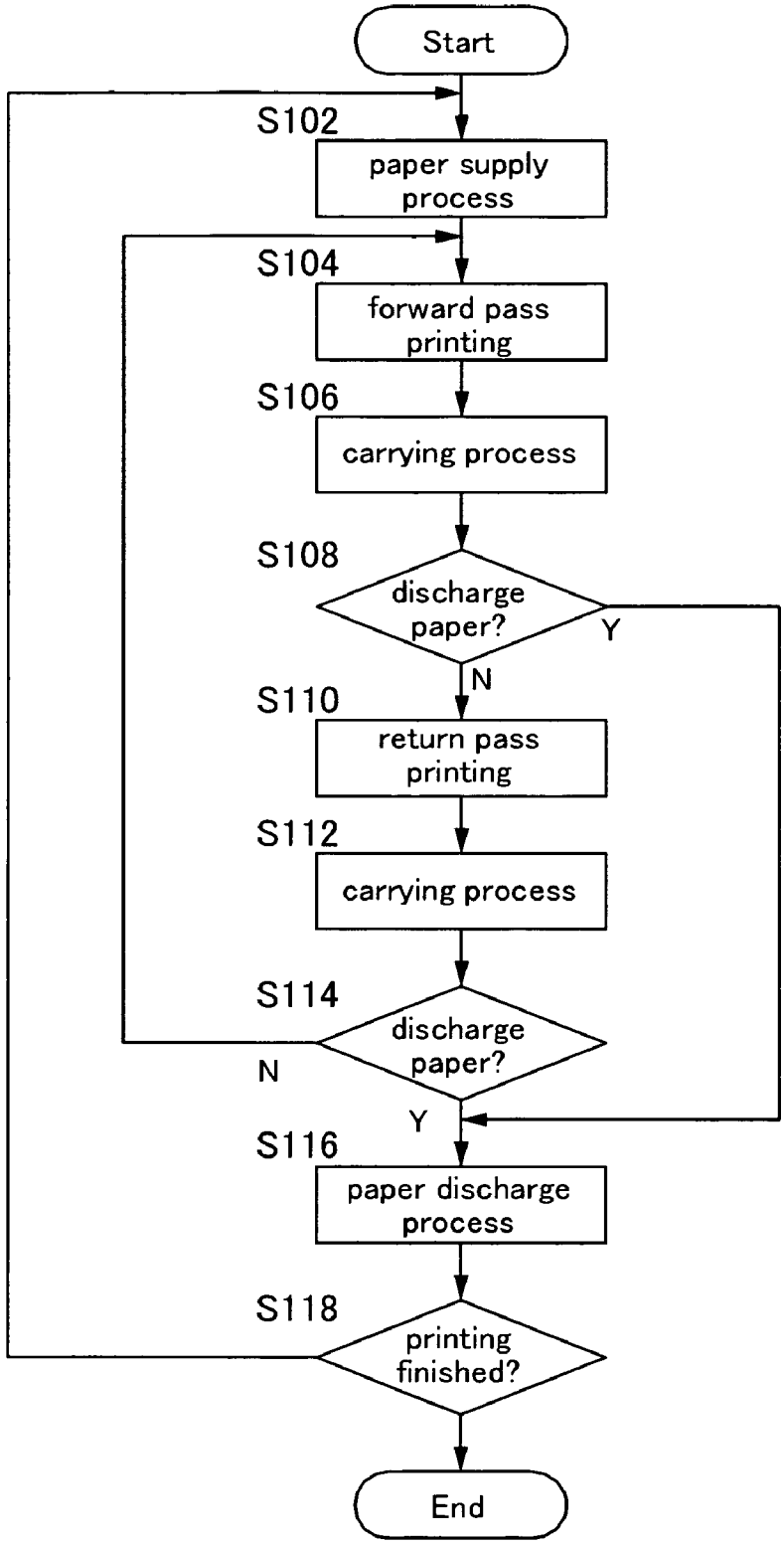
FIG. 9 is a flowchart illustrating an example of the printing process.

The following is a description concerning a printing operation of the above-described inkjet printer 1. Here, "bidirectional printing" is described as an example. FIG. 9 is a flowchart showing an example of the process procedure of the printing operation of the inkjet printer 1. The processes described below are performed when the controller 126 reads out programs from the main memory 127 and controls each of the carriage motor controller 128, the carry controller 130, and the head drive section 132, for example, in accordance with the programs.

When the controller 126 receives print data from the computer 140, the controller 126 first performs a paper supply process in order to carry out printing based on the print data (S102). In the paper supply process, a medium S to be printed is supplied into the inkjet printer 1 and is carried to a print starting position (also referred to as an indexed position). The controller 126 rotates the paper supply roller 13 to send the medium S to be printed up to the carry roller 17A. The controller 126 rotates the carry roller 17A such that the medium S that has been sent from the paper supply roller 13 is positioned at the print starting position (in the vicinity of the upstream on the platen 14).

Next, the controller 126 performs a printing process (corresponding to "a moving-and-ejecting operation") for carrying out printing on the medium S by driving the carriage motor 42 via the carriage motor controller 128 to move the carriage 41 relative to the medium S. Herein, forward pass printing is first performed in which ink is ejected from the head 21 while the carriage 41 is moved in one direction along the guide rail 46 (S104). The controller 126 causes ink to be ejected by driving the head 21 based on the print data while moving the carriage 41 by driving the carriage motor 42. The ink ejected from the head 21 reaches the medium S, forming dots.

After printing has been carried out in this manner, the controller 126 performs a carrying process (corresponding to "a carrying operation") for carrying the medium S by a predetermined amount (S106). Herein, the controller 126 rotates the carry roller 17A by driving the carry motor 15 via the carry controller 130, and carries the medium S by a predetermined amount in the carrying direction relative to the head 21. With this carrying process, the head 21 can print onto a region that is different from the region printed previously.

After the carrying process has been performed in this manner, the controller 126 performs a paper discharge determination in which it is determined whether or not to discharge the paper (S108). Herein, if there is no more data to be printed onto the medium S that is currently being printed, then the controller 126 performs a paper discharge process (S116) On the other hand, if there is data left to be printed onto the medium S that is currently being printed, then the controller 126 performs return pass printing without performing a paper discharge process (S110). In this return pass printing, printing is carried out while the carriage 41 is moved along the guide rail 46 in the opposite direction to the previous forward pass printing. Also here, the controller 126 moves the carriage 41 by rotatively driving the carriage motor 42 in the opposite direction as before via the carriage motor controller 128, and causes ink to be ejected by driving the head 21 based on the print data, thereby carrying out printing.

After return pass printing has been performed, a carrying process is performed (S112), and then a paper discharge determination is performed (S114). Here, if there is data left to be printed onto the medium S that is currently being printed, then a paper discharge process is not performed, but the procedure returns to step S104, where forward pass printing is carried out again (S104). On the other hand, if there is no more data to be printed onto the medium S that is currently being printed, then a paper discharge process is performed (S116).

After the paper discharge process has been performed, a print termination determination is performed in which it is determined whether or not to terminate printing (S118). Here, based on the print data from the computer 140, it is checked whether or not there is a further medium S to be printed left. If there still is another medium S to be printed, then the procedure returns to step S102, where the paper supply process is performed again to restart printing. On the other hand, if there is no further medium S to be printed, then the printing process is terminated.

===Capping Device===

Figure 10:
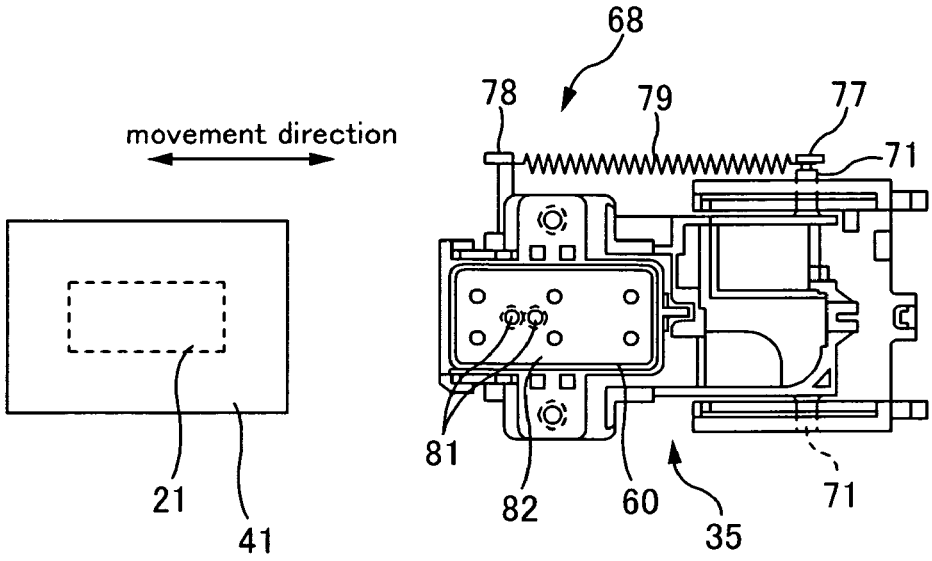
FIG. 10 is a plan view for illustrating a capping device.
Figure 11:
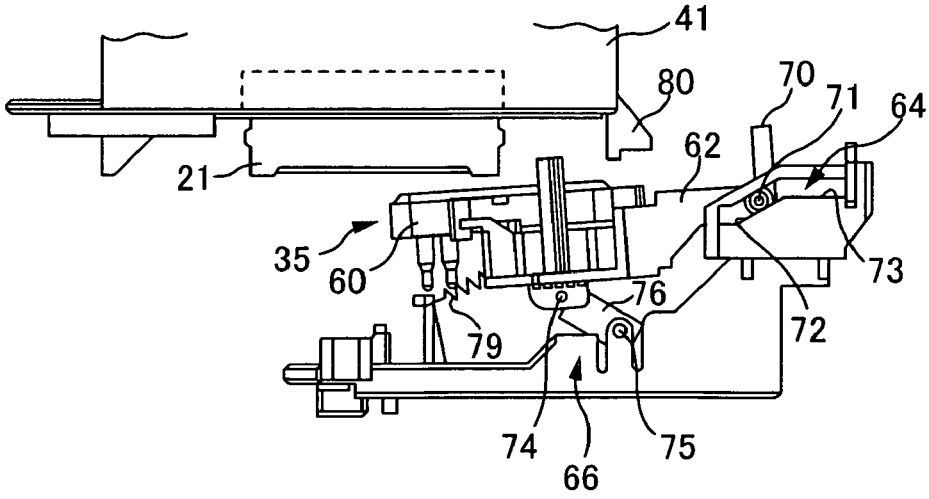
FIG. 11 is a side view for illustrating the capping device.

The capping device 35 is described in detail. FIG. 10 is a view obtained when the capping device 35 is viewed from above. FIG. 11 is a view obtained when the capping device 35 is viewed from the side. Using these figures and FIG. 2, the capping device 35 is described.

The capping device 35 has a cap 60, a slider 62, a guide mechanism 64, a rotation mechanism 66, and a recovery mechanism 68. The cap 60 is provided such that the cap 60 can move using the slider 62, the guide mechanism 64, the rotation mechanism 66, and the recovery mechanism 68. The slider 62 is provided so as to be in one piece with the cap 60. The slider 62 has a contact section 70. The guide mechanism 64 has a guide shaft 71 and a guide 72. The guide shaft 71 is provided so as to be in one piece with the slider 62. The guide 72 has a guide hole 73, and the guide hole 73 regulates the direction in which the guide shaft 71 can move. The rotation mechanism 66 has a slider-side member 74, a main-unit-side member 75, and a rotation shaft 76. The slider-side member 74 is provided so as to be in one piece with the slider 62, and is rotatably linked to the rotation shaft 76. The main-unit-side member 75 is fixed on the side of the main unit, and is rotatably linked to the rotation shaft 76. The recovery mechanism 68 has a slider-side spring hook member 77, a main-unit-side spring hook member 78, and a spring 79. The slider-side spring hook member 77 is provided with a groove for hooking the spring, and is provided so as to be in one piece with the guide shaft 71. The main-unit-side spring hook member 78 is a member in the shape of a hook for hooking the spring, and is fixed on the side of the main unit. One end of the spring 79 is hooked on the slider-side spring hook member 77, and the other end is hooked on the main-unit-side spring hook member 78, and thus the spring 79 applies a force in the direction in which both ends move closer to each other.

When the carriage 41 moves in the direction to the right in the drawing, a projecting section 80 that is provided so as to be in one piece with the carriage 41 is brought into contact with the capping device 35. When the carriage 41 further moves, the slider 62 receives a force via the contact section 70, and moves against the force of the spring 79. When the slider 62 moves, the guide shaft 71 is regulated by the guide hole 73. Furthermore, the movement direction of the slider 62 is regulated also by the rotation mechanism 66. Thus, the slider 62 moves in the direction that is allowed by the guide mechanism 64 and the rotation mechanism 66. With the movement of the slider 62, the cap 60 moves upward while moving in the right direction, and the cap 60 covers the head 21. The position of the carriage 41 at that time is referred to as a home position (corresponding to "a predetermined position" in this embodiment).

When the carriage 41 moves from the home position to the left side in the drawing, the slider 62 receives a recovery force of the spring 79 and moves. Also at the time of this movement, the slider 62 moves in the direction that is allowed by the guide mechanism 64 and the rotation mechanism 66. With the movement of the slider 62, the cap 60 moves downward while moving in the left direction, and the cap 60 is removed from the head 21.

When the carriage 41 is positioned at the home position, the cap 60 keeps the head 21 away from the outside air by closing off the head 21. In other words, the cap 60 functions as a cover for preventing the nozzles from being dried. When the cap 60 covers the head 21, ink is prevented from evaporating from the nozzles, and thus it is possible to prevent clogging in the nozzles due to the ink becoming thicker and the viscosity thereof increasing.

Furthermore, when the carriage 41 is positioned at the home position, a spacing between the head 21 and the cap 60 is sealed. The cap 60 is provided with suction openings 81, and when the pressure at the suction openings 81 becomes negative, ink in the nozzles is sucked. In other words, the cap 60 is provided with a function as a housing for sucking ink. With ink suction, bubbles in the nozzles are eliminated, and thus it is possible to prevent an ejection failure of ink.

Furthermore, around the timing at which the projecting section 80 of the carriage 41 and the contact section 70 are brought into contact with each other, the cap 60 is already opposed to the head 21. When the carriage 41 is moved to such a position, the inkjet printer 1 performs a flushing process (the position of the carriage 41 at that time is referred to as a "flushing position"). The "flushing process" refers to a process for preventing clogging in the nozzles by causing ink to be preliminarily ejected (i.e., causing ink to be ejected in a state where the head is not in opposition to paper) from the head 21. In other words, the cap 60 functions as an ink receiver in the flushing process. It should be noted that the cap 60 is provided with an absorbent member 82 (such as a sponge) for absorbing ink.

When the power of the inkjet printer 1 is turned off, the controller 126 moves the carriage 41 to the home position in order to prevent ink from evaporating from the nozzles. Furthermore, in this embodiment, the controller 126 moves the carriage 41 to the home position in order to cover the head 21 with the cap 60 in a standby process described later.

===Drive Signal Generating Circuit===

Figure 12:
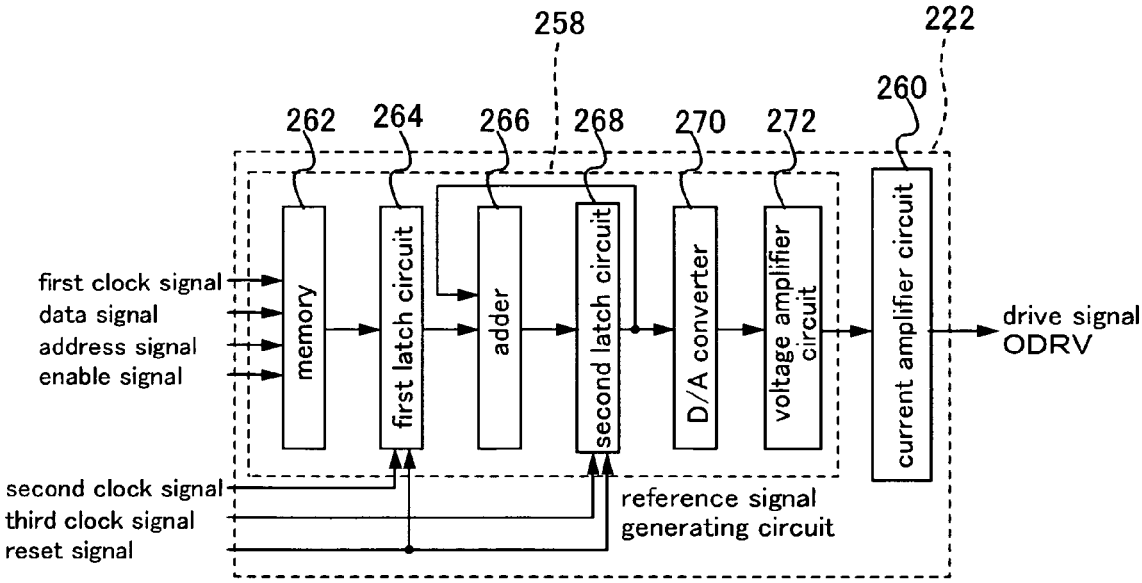
FIG. 12 is an explanatory diagram of an example of a drive signal generating circuit.

The following is a description concerning the drive signal generating circuit 222 for generating the drive signal ODRV. FIG. 12 is a configuration diagram illustrating an example of the drive signal generating circuit 222. The drive signal generating circuit 222 has a reference signal generating circuit 258 and a current amplifier circuit 260. The reference signal generating circuit 258 is a circuit for generating a signal serving as a reference for the drive signal ODRV that is output from the drive signal generating circuit 222. In this embodiment, the reference signal generating circuit 258 has a memory 262, a first latch circuit 264, an adder 266, a second latch circuit 268, a D/A converter 270 (digital-analog converter), and a voltage amplifier circuit 272.

The memory 262 stores, in association with addresses, a plurality of types of data on the level change amount. The memory 262 has a first clock signal input terminal, a data signal input terminal, an address signal input terminal, an enable signal input terminal, and a data signal output terminal.

A data signal indicates the amount of change in a drive signal ODRV per unit time. An address signal indicates a storage address to which the data on the amount of change in the signal is stored or a read address for the data on the level change amount to be read out. The memory 262 stores the data on the amount of change in the signal in the storage address specified by the address signal. The data on the amount of change in the signal is stored when required signals are input from the first clock signal input terminal, the data signal input terminal, the address signal input terminal, and the enable signal input terminal. Furthermore, the memory 262 outputs the data on the amount of change in the signal specified by the read address to the first latch circuit 264. This read address also is specified by the address signal that is input from the address signal input terminal.

The first latch circuit 264 is electrically connected to the memory 262, and reads out the data on the amount of change in the signal stored in the memory 262 every time a second clock signal is input. In other words, the data on the amount of change in the signal output from the memory 262 is latched. An output of the first latch circuit 264 and an output of the second latch circuit 268 are input to the adder 266. Then, an output of the adder 266 is input to the second latch circuit 268. More specifically, the adder 266 outputs an addition value obtained by adding the output of the first latch circuit 264 and the output of the second latch circuit 268. The second latch circuit 268 latches the addition value that is output from the adder 266 every time a third clock signal is input.

The D/A converter 270 converts the output from the second latch circuit 268, that is, the addition value that is output from the adder 266, into an analog signal. The voltage amplifier circuit 272 amplifies the voltage of the analog signal that is output from the D/A converter 270 to a voltage that can drive the piezo elements 254. Then, the generated signal whose voltage has been amplified with the voltage amplifier circuit 272 is output from the reference signal generating circuit 258 as a reference signal for the drive signal ODRV.

Figure 13:
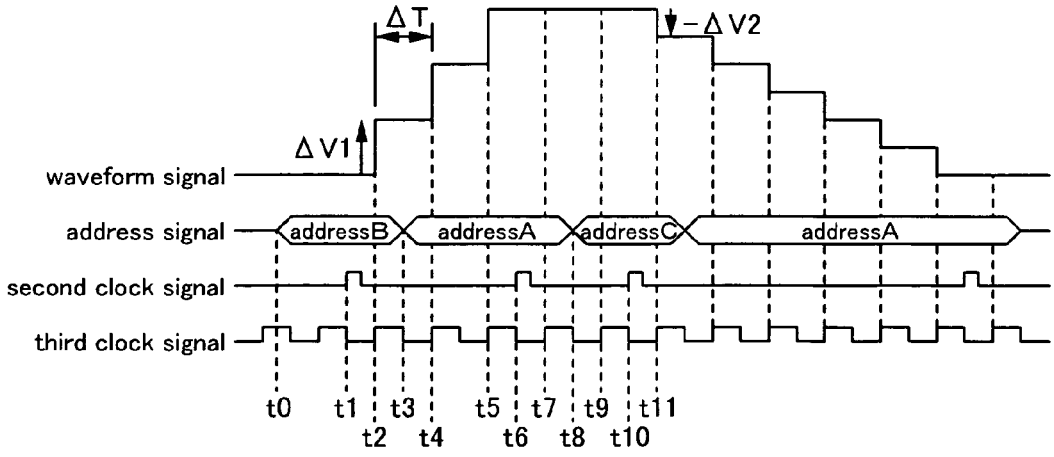
FIG. 13 is an explanatory diagram of an operation of the drive signal generating circuit.

The following is a description concerning a concrete example of the operation of the reference signal generating circuit 258. More specifically, the operation of the memory 262, the first latch circuit 264, the adder 266, and the second latch circuit 268 is described. FIG. 13 is a diagram illustrating the operation of the reference signal generating circuit 258.

The controller 126 outputs an address signal to the memory 262. The memory 262 outputs data at a read address specified by the address signal (t0−). In this example, the controller 126 outputs an address signal indicating an address B, and the memory 262 outputs a change amount ΔV1 as the data on the amount of change in the signal. Next, the controller 126 switches the second clock signal to the H level (t1). More specifically, a clock pulse is output. The first latch circuit 264 that has received this clock pulse latches the change amount ΔV1. Subsequently, the controller 126 changes the read address (t3−). Accordingly, the controller 126 outputs an address signal indicating an address A. The memory 262 outputs a voltage value 0 as the data on the amount of change in the signal. Furthermore, the controller 126 switches the third clock signal to the H level in every period AT. More specifically, a clock pulse is output. Every time the clock pulse is received, the output of the second latch circuit 268 increases by the change amount ΔV1 (t2, t4, t5).

Next, the controller 126 switches the second clock signal to the H level (t6). The first latch circuit 264 that has received this clock pulse latches the voltage value 0 corresponding to the address A. Thus, even when the third clock signal is switched to the H level, the output of the second latch circuit 268 is maintained at a constant potential (t7, t9). Furthermore, the controller 126 changes the read address to an address C (t8−), and makes a change amount −ΔV2 as the data of the amount of change in the signal be output from the memory 262. The change amount −ΔV2 is latched by the first latch circuit 264 at a timing when the second clock signal is turned to the H level the next time (t10). Thus, every time the third clock signal is turned to the H level, the output of the second latch circuit 268 decreases by the change amount −ΔV2 (t11−). In this manner, the addition value that is output from the second latch circuit 268 is generated. The addition value that has been output from the second latch circuit 268 is converted into an analog signal by the D/A converter 270, the voltage thereof is amplified by the voltage amplifier circuit 272, and then the analog signal is output as a reference signal from the reference signal generating circuit 258.

The reference signal that has been output from the reference signal generating circuit 258 is input to the current amplifier circuit 260. The current amplifier circuit 260 amplifies the reference signal that has been output from the reference signal generating circuit 258 to a current for driving the piezo elements 254. The current amplifier circuit 260 is configured as below.

Figure 14:
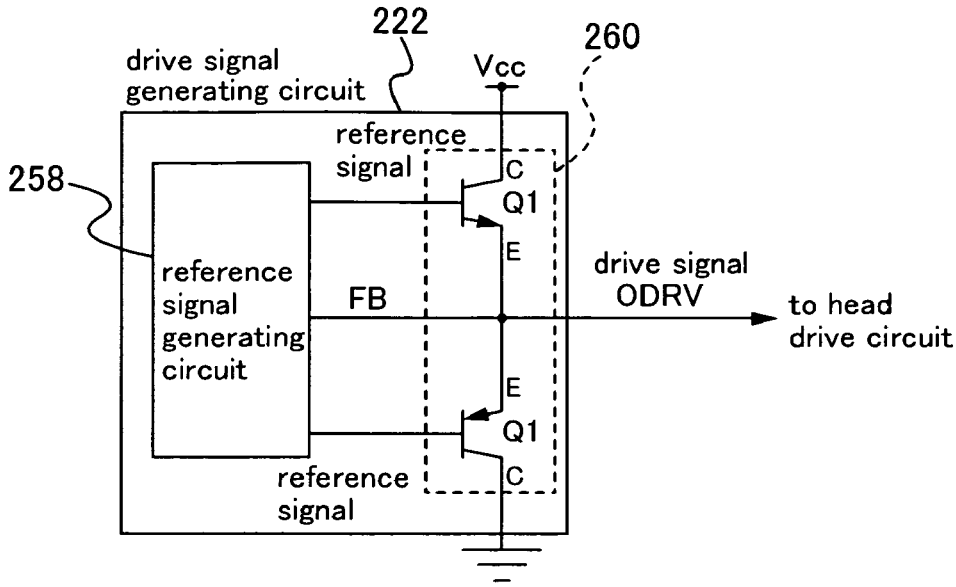
FIG. 14 is an explanatory diagram of a current amplifier circuit constituting the drive signal generating circuit.

FIG. 14 shows an example of the current amplifier circuit 260. The current amplifier circuit 260 has a voltage rise transistor Q1 and a voltage drop transistor Q2. The voltage rise transistor Q1 is an NPN transistor in which its collector is connected to a power source Vcc and its emitter is connected to an output signal line of the drive signal ODRV. Furthermore, the voltage drop transistor Q2 is a PNP transistor in which its collector is earthed, that is, connected to the ground and its emitter is connected to the output signal line of the drive signal ODRV. More specifically, the two transistors Q1 and Q2 are connected to each other on the side of the emitters, and the drive signal ODRV is output from the connection point.

Each of the voltage rise transistor Q1 and the voltage drop transistor Q2 is controlled based on the reference signal from the reference signal generating circuit 258. When the voltage rise transistor Q1 is turned on based on the reference signal from the reference signal generating circuit 258, the drive signal ODRV rises and the piezo elements are charged. On the other hand, when the voltage drop transistor Q2 is turned on based on the reference signal from the reference signal generating circuit 258, the drive signal ODRV drops and the piezo elements are discharged. In other words, the voltage rise transistor Q1 is a charge transistor, and the voltage drop transistor Q2 is a discharge transistor. The piezo elements have a capacitive load C.

It should be noted that the drive signal ODRV that has been generated by the current amplifier circuit 260 is fed back to the reference signal generating circuit 258. The reason for this is that the reference signal generating circuit 258 monitors the potential of the drive signal ODRV that is output from the current amplifier circuit 260 and controls the two transistors Q1 and Q2 based on the deviation from the target potential.

===Heat Generation in Drive Signal Generating Circuit===

As described above, the drive signal generating circuit 222 has the two transistors Q1 and Q2 as the current amplifier circuit 260 in which the current of the reference signal generated by the reference signal generating circuit 258 is amplified. Heat is generated when the two transistors Q1 and Q2 generate the drive signal ODRV by amplifying the reference signal that is output from the reference signal generating circuit 258. When the transistors Q1 and Q2 have high temperature due to this heat generation, there is a possibility that the two transistors Q1 and Q2 are damaged.

Thus, in this embodiment, in order to avoid a situation in which the two transistors Q1 and Q2 have high temperature and are broken, the temperature sensor 88 (see FIG. 4) is provided, so that the temperature state of the transistors Q1 and Q2 is monitored. The controller 126 monitors the temperature state of the two transistors Q1 and Q2.

Figure 15A:
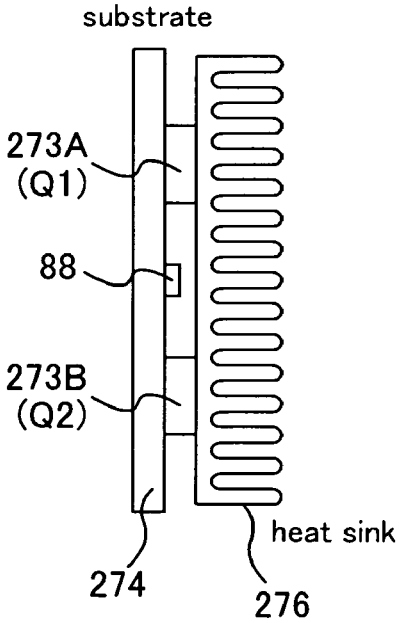
FIG. 15A is a side view illustrating a setting example of a temperature sensor.
Figure 15B:
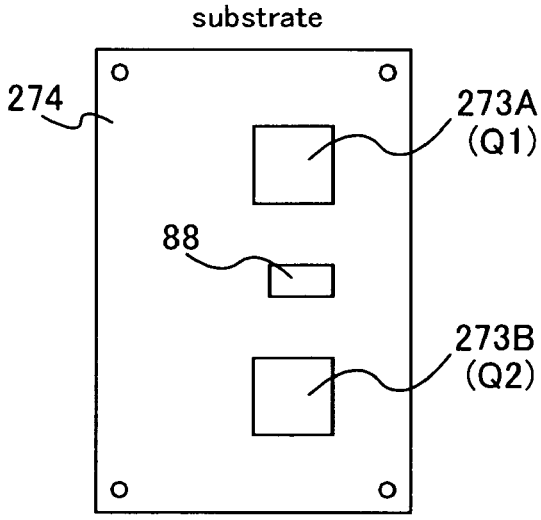
FIG. 15B is a plan view illustrating the setting example of the temperature sensor.

FIGS. 15A and 15B illustrate a setting example of the temperature sensor 88. FIG. 15A is a side view thereof, and FIG. 15B is a plan view thereof.

As shown in FIGS. 15A and 15B, the two transistors Q1 and Q2 are respectively packaged as two elements 273A and 273B and are integrally mounted on a substrate 274. A heat sink 276 is mounted on the two elements 273A and 273B that are mounted on the substrate 274. More specifically, the two elements 273A and 273B in which the two transistors Q1 and Q2 are accommodated are provided so as to be interposed between the mounting substrate 274 and the heat sink 276. The heat sink 276 is in contact with the two elements 273A and 273B. When the transistors Q1 and Q2 inside the two elements 273A and 273B generate heat, the heat is transferred via the outer face of the elements 273A and 273B to the heat sink 276, and the heat is released. FIG. 15B shows a state in which the heat sink 276 is removed.

On the other hand, as shown in FIGS. 15A and 15B, the temperature sensor 88 is interposed between the two elements 273A and 273B, and is mounted on the substrate 274 together with the two elements 273A and 273B. The temperature sensor 88 detects the temperature in the vicinity of the two elements 273A and 273B, and indirectly monitors the heat generation state of the two transistors Q1 and Q2.

The detection result of the temperature sensor 88 is transmitted to the controller 126 (see FIG. 4). From the temperature sensor 88, the controller 126 acquires the detected temperature of the temperature sensor 88. Then, based on the acquired information, the controller 126 monitors the heat generation state of the two transistors Q1 and Q2, and attempts to prevent the two transistors Q1 and Q2 from being damaged.

Herein, semiconductors constituting the transistors Q1 and Q2 have a point that is referred to as a junction section. Heat is generated by the transistors Q1 and Q2 mainly at this section. Generated heat is conducted via the packages of the elements 273A and 273B accommodating the transistors Q1 and Q2, and is released to the outside. The temperature sensor 88 indirectly detects the heat emitted from the two elements 273A and 273B.

The temperature at the junction section between the transistors Q1 and Q2 at which heat is generated is generally referred to as a junction temperature. When the junction temperature reaches a predetermined temperature, the transistors Q1 and Q2 are broken by heat.

===Damage Prevention of Transistors Q1 and Q2===

The following is a description concerning the damage prevention of the transistors Q1 and Q2 with the controller 126. In this embodiment, when the controller 126 carries out printing on the medium S, the controller 126 acquires the detected temperature from the temperature sensor 88, and judges whether or not the two transistors Q1 and Q2 have entered a high-temperature state, based on the detected temperature. Herein, if it is determined that at least either one of the two transistors Q1 and Q2 has high temperature, then the controller 126 performs a cooling down process for lowering the temperature of the two transistors Q1 and Q2. The cooling down process is performed by stopping the generation of the drive signal ODRV from the drive signal generating circuit 222. That is, the operation in which the drive signal ODRV is generated by the drive signal generating circuit 222 is stopped. Thus, the operation in which the current is amplified by the two transistors Q1 and Q2 is stopped, and thus it is possible to suppress heat generation at the two transistors Q1 and Q2. Furthermore, when the operation is stopped, it is also possible to release the heat from the two transistors Q1 and Q2.

The following is a description concerning the cooling down process of the transistors Q1 and Q2 actually performed by the controller 126.

(A) Standby at Every Moving-and-ejecting Operation

The "standby at every moving-and-ejecting operation" refers to a standby operation that is performed at every moving-and-ejecting operation in which printing is carried out on a medium by ejecting ink from the nozzles #1 to #180 when the carriage 41 moves in the carriage movement direction. More specifically, after the carriage 41 has moved in the carriage movement direction to carry out printing by ejecting ink from the nozzles #1 to #180 toward the medium, the printing process is paused by halting the ejection of ink for a predetermined time. Then, after the predetermined time has passed since the halt of the ejection of ink, the printing process is resumed by moving the carriage 41 in the carriage movement direction and ejecting ink again. Furthermore, after the carriage 41 has moved in the carriage movement direction, the printing process is again paused by halting the ejection of ink for a predetermined time. In this manner, every time an operation is performed in which the carriage 41 moves in the carriage movement direction and ink is ejected from the nozzles #1 to #180 toward the medium, the printing process is paused by performing an operation of halting the ejection of ink. It should be noted that the standby operation is set between the moving-and-ejecting operation in which printing is carried out on a medium by ejecting ink from the nozzles #1 to #180 when the carriage 41 moves in the carriage movement direction, and the carrying operation of the medium performed by the carrying section (see FIG. 3). Accordingly, it is possible to temporarily stop the operation in which the drive signal ODRV is generated by the drive signal generating circuit 222. Thus, every time the carriage 41 moves in the carriage movement direction, heat can be released from the two transistors Q1 and Q2. Furthermore, it is possible to suppress an increase in the temperature at the two transistors Q1 and Q2.

It should be noted that, herein, the controller 126 performs the operation of pausing the printing process by halting the ejection of ink for a predetermined time after the carriage 41 has moved in the carriage movement direction.

Figure 16:
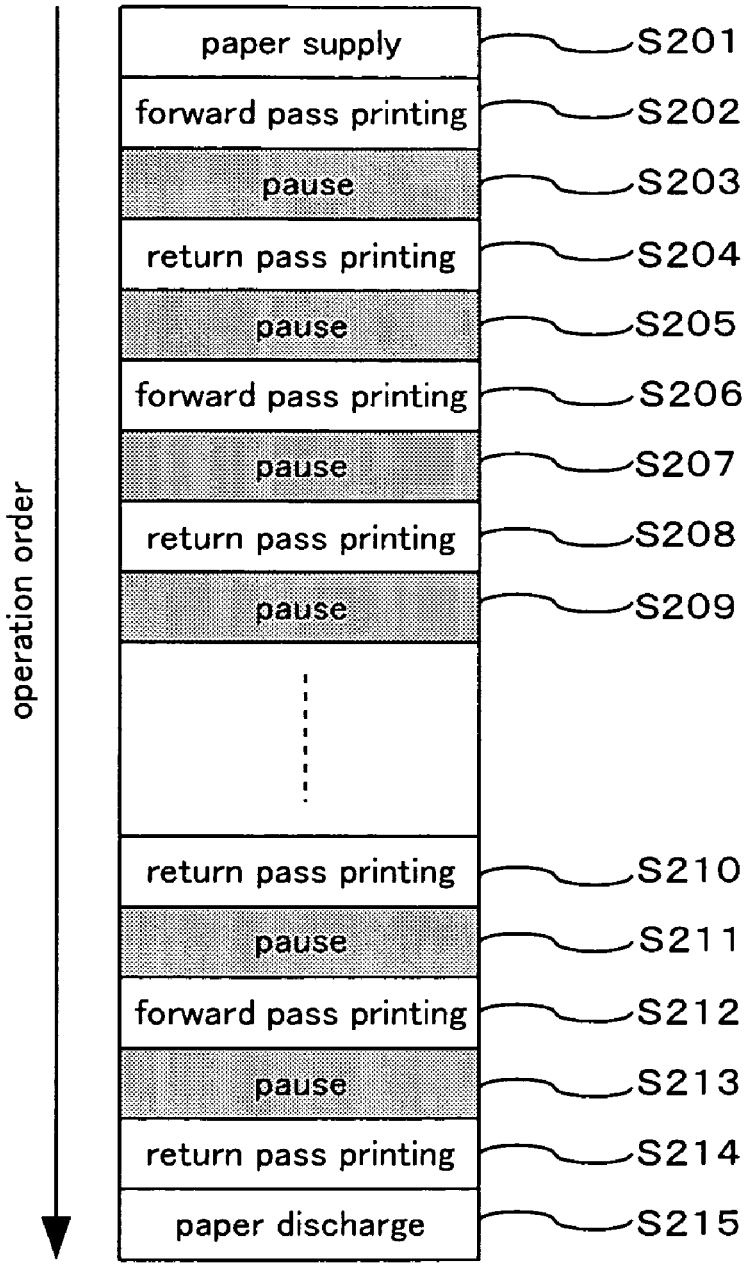
FIG. 16 is an explanatory diagram of an example of a standby operation at every moving-and-ejecting operation.

FIG. 16 illustrates an example of the process flow in a case where every time the carriage 41 moves in the carriage movement direction, the operation of pausing the printing process by halting the ejection of ink is performed, so that the generation of the drive signal ODRV by the drive signal generating circuit 222 is stopped. Herein, the printing process is described by taking a case of "bidirectional printing" as an example.

When "bidirectional printing" is carried out, the controller 126 first performs a paper supply operation in which the medium S is supplied (S201). With this process, the controller 126 carries the medium S to a predetermined print starting position. Next, the controller 126 ejects ink from the nozzles #1 to #180 while moving the carriage 41 in one direction. With this process, the controller 126 carries out printing on the medium S (S202). It should be noted that an operation of carrying out printing on the medium S while moving the carriage 41 in one direction in this manner is referred to as "forward pass printing" herein.

After "the forward pass printing" has been carried out in this manner, the controller 126 pauses the printing process by stopping the operation of ejecting ink for a predetermined time (S203). Then, after the predetermined time has passed, the controller 126 ejects ink from the nozzles #1 to #180 while moving the carriage 41 in the opposite direction to the above-mentioned direction (S204). It should be noted that an operation of carrying out printing on the medium S while moving the carriage 41 in the opposite direction to the above-mentioned direction in this manner is referred to as "return pass printing" herein. After "the return pass printing" has been carried out in this manner, the controller 126 again pauses the printing process by stopping the operation of ejecting ink for a predetermined time (S205). Then, after the predetermined time has passed, the controller 126 again performs "forward pass printing" (S206).

After this point, every time the controller 126 carries out "forward pass printing" or "return pass printing" (S208, S210, S212, S214), during an intermission of the printings, the controller 126 repeatedly performs the pausing operation in which the printing process is paused by stopping the operation of ejecting ink for a predetermined time (S207, S209, S211, S213). Then, if there is no data left to be printed, then the controller 126 performs a paper discharge process (S215), and the printing process is terminated.

Herein, a comparatively short time, for example, one second to several seconds, such as one second, two seconds and five seconds, is set as the time for which the controller 126 stops the operation of ejecting ink.

<Other Process Examples>

Figure 17:
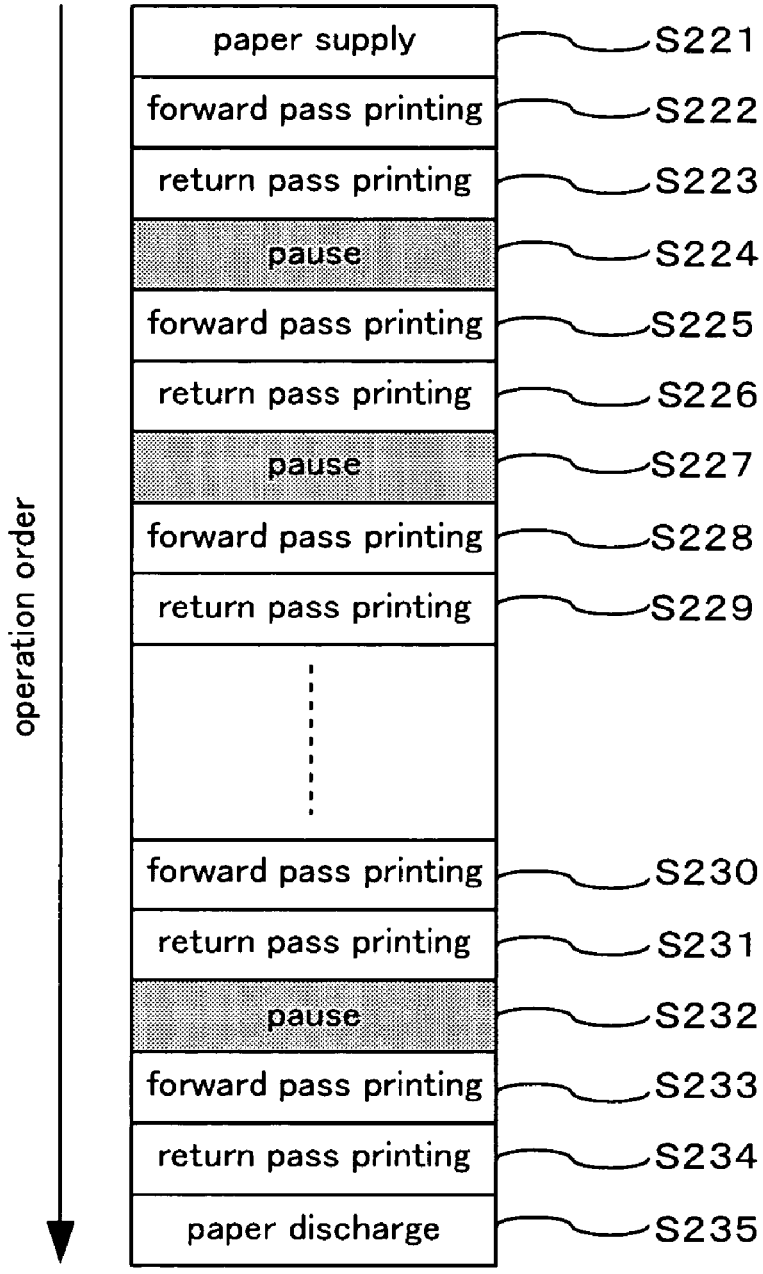
FIG. 17 is an explanatory diagram of another example of a standby operation at every moving-and-ejecting operation.

FIG. 17 illustrates another process example. Herein, the operation of pausing the printing process by halting the ejection of ink is not performed every time the carriage 41 moves in the carriage movement direction, but the operation of pausing the printing process by halting the ejection of ink is performed every time after both the "forward pass printing" and "return pass printing" are terminated. More specifically, the controller 126 first performs a paper supply operation in which the medium S is supplied (S221), performs "forward pass printing" (S222), and performs "return pass printing" (S223), and then pauses the printing process by stopping the operation of ejecting ink for a predetermined time (S224). Furthermore, the controller 126 again performs "forward pass printing" (S225), and performs "return pass printing" (S226), and then again pauses the printing process by stopping the operation of ejecting ink for a predetermined time (S227). In this manner, every time after the controller 126 carries out "forward pass printing" and "return pass printing" (S228, S229, S230, S231), the controller 126 pauses the printing process (S232). In this manner, the operation of pausing the printing process by halting the ejection of ink may be performed every time after "forward pass printing" and "return pass printing" are carried out. Then, if there is no data left to be printed, then the controller 126 performs a paper discharge process (S235), and the printing process is terminated.

(B) Capping Standby

"Capping standby" refers to an operation of performing standby by capping the head 21 with the capping device 35. More specifically, when "capping standby" is performed, the carriage 41 is moved to the home position at which the capping device 35 is provided. Then, the head 21 is covered with the capping device 35 and thus the ejection openings of the nozzles #1 to #180 in each of the nozzle rows 211C, 211M, 211Y, and 211K are blocked. Then, this blocked state is kept for a predetermined time. During this time, the operation in which the drive signal ODRV is generated by the drive signal generating circuit 222 is stopped. Accordingly, heat can be released from the two transistors Q1 and Q2, and thus it is possible to suppress an increase in the temperature. Furthermore, herein, the controller 126 performs the capping standby operation.

Figure 18:
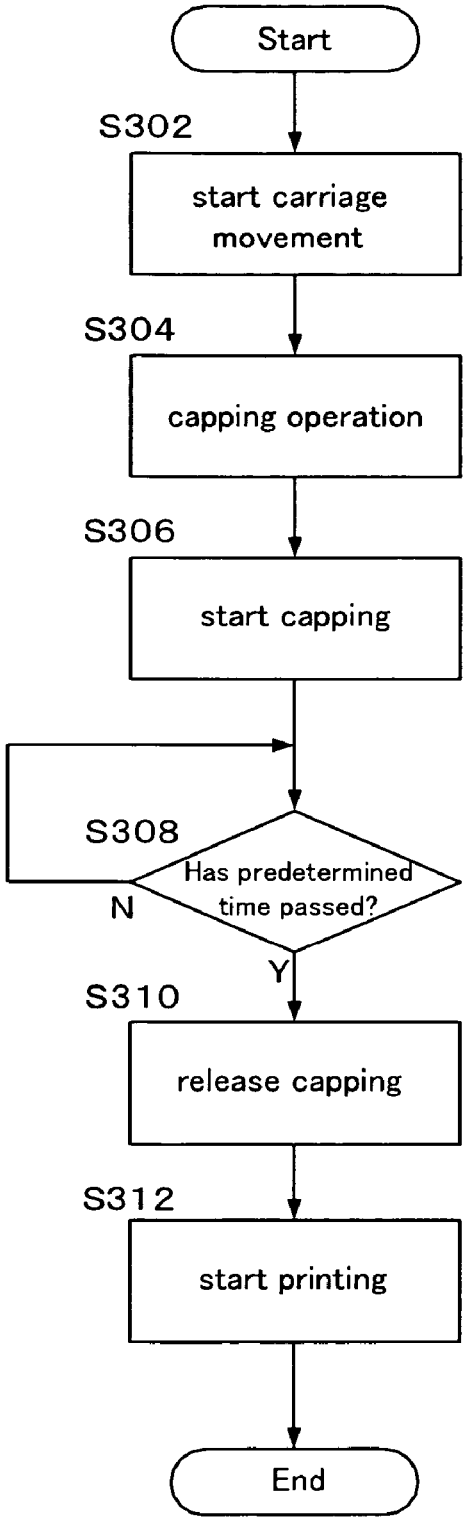
FIG. 18 is a flowchart illustrating a standby operation accompanied by capping.

FIG. 18 illustrates an example of the process flow in a case where the operation based on the capping standby described above is performed.

When "capping standby" is performed, the controller 126 first moves the carriage 41 to the home position at which the capping device 35 is provided (S302). Next, when the carriage 41 reaches the home position, a capping operation is performed in which the capping device 35 automatically covers and caps the head 21 (S304). In this way, the capping is started in which the ejection openings of the nozzles #1 to #180 in each of the nozzle rows 211C, 211M, 211Y, and 211K provided at the head 21 are blocked (S306). Herein, the operation in which the drive signal ODRV is generated by the drive signal generating circuit 222 has been stopped. In other words, the operation in which the current is amplified by the two transistors Q1 and Q2, which are formed in the drive signal generating circuit 222, has been stopped.

After the ejection openings of the nozzles #1 to #180 in each of the nozzle rows 211C, 211M, 211Y, and 211K of the head 21 have been blocked in this manner, the controller 126 checks whether or not a predetermined time has passed since the capping start (S308). Herein, if the time that has passed since the capping start has not reached the predetermined time, then the controller 126 again checks whether or not the predetermined time has passed since the capping start (S308). The controller 126 performs the check until the predetermined time has passed. Accordingly, the operation in which the drive signal ODRV is generated by the drive signal generating circuit 222 is stopped for the predetermined time. Thus, heat is released from the two transistors Q1 and Q2, and thus it is possible to suppress an increase in the temperature at the two transistors Q1 and Q2. In addition, during this time, the ejection openings of the nozzles #1 to #180 in each of the nozzle rows 211C, 211M, 211Y, and 211K of the head 21 are blocked with the capping device, and thus evaporation of ink from the nozzles #1 to #180 is suppressed to prevent drying, so that it is possible to prevent clogging in the nozzles due to the ink being thicker.

Then, after the predetermined time has passed since the capping start, the controller 126 moves the carriage 41 in the direction away from the home position. Accordingly, the capping device 35 is separated from the head 21, and the capping of the head 21 by the capping device 35 is released (S310).

After the head 21 has been released from the capping with the capping device 35 in this manner, the controller 126 starts the printing process (S312). Then, the process is terminated.

Herein, a comparatively long time, for example, ten seconds or longer such as ten seconds, 15 seconds, 30 seconds, and 60 seconds is set as the time from when the capping is started to when the capping is released, that is, as the predetermined time. More specifically, herein, "(B) capping standby" is set to have a higher cooling down effect than "(A) standby at every moving-and-ejecting operation".

Furthermore, when the carriage 41 is separated from the capping device 35, the controller 126 may perform a flushing process. The flushing process refers to a process in which ink is preliminarily ejected (ink is ejected without the head opposing the paper) from the nozzles #1 to #180 in each of the nozzle rows 211C, 211M, 211Y, and 211K of the head 21, as described above. When the controller 126 performs the flushing process, clogging and the like in the nozzles #1 to #180 after the capping can be further prevented.

===Process of Controller===

The controller 126 of this embodiment performs the two types of standby operations (A) and (B) in distinction from each other depending on the detected temperature from the temperature sensor 88. Herein, if the temperature of the transistors Q1 and Q2 does not reach such high temperature, then the controller 126 performs "(A) standby at every moving-and-ejecting operation". On the other hand, if the temperature of the transistors Q1 and Q2 reaches very high temperature, then the controller 126 performs "(B) capping standby". Herein, the controller 126 judges whether "(A) standby at every moving-and-ejecting operation" should be performed or "(B) capping standby" should be performed, based on the detected temperature from the temperature sensor 88.

When the two types of standby operations (A) and (B) are performed in this manner in distinction from each other depending on the detected temperature from the temperature sensor 88, it is possible to suppress an increase in the temperature of the transistors Q1 and Q2 while preventing the throughput from decreasing.

Figure 19:
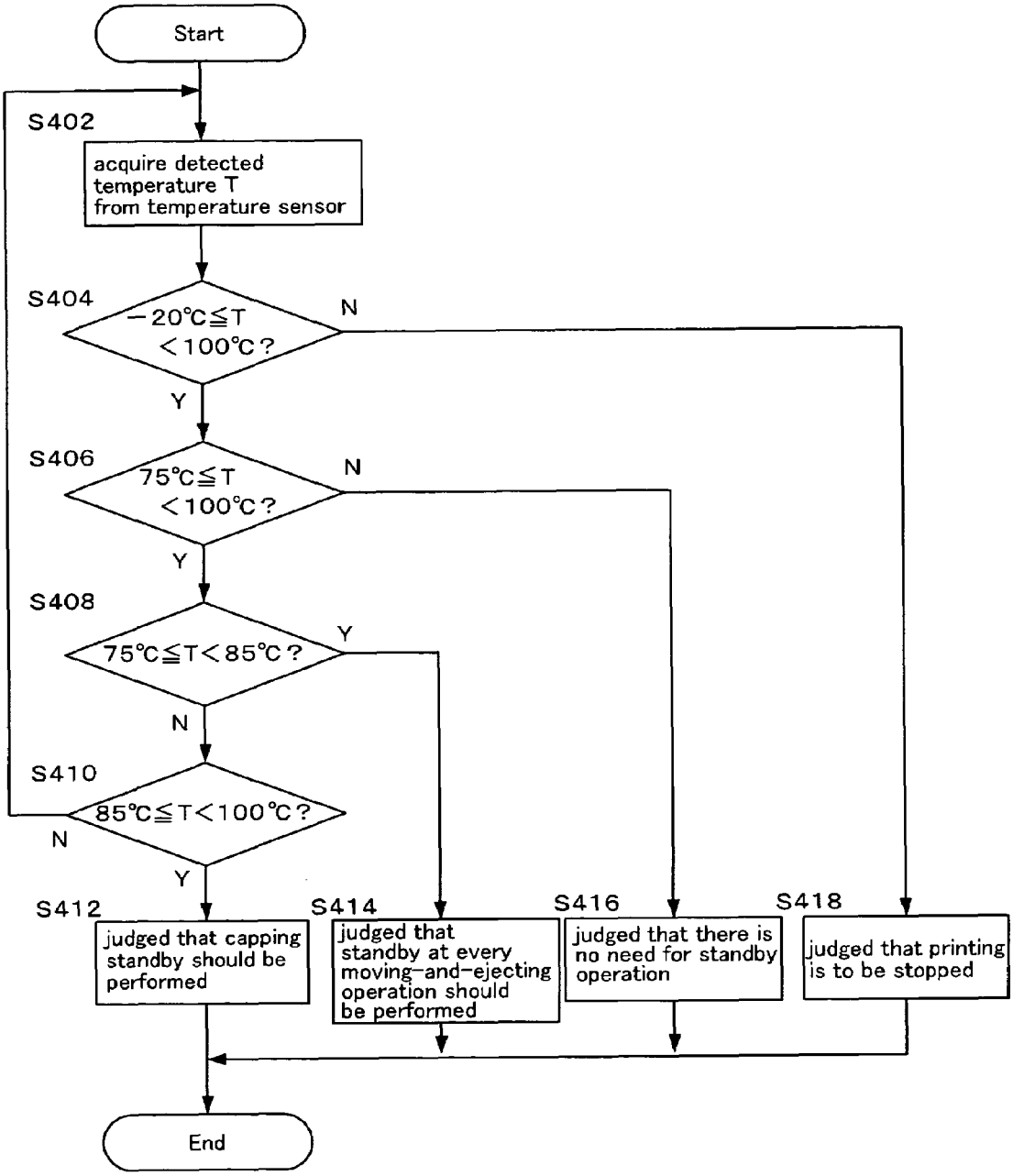
FIG. 19 is a flowchart illustrating a process example of a controller.

FIG. 19 illustrates an example of a judgment process performed by the controller 126. Herein, the temperature (corresponding to "a first temperature") for judging whether or not "(A) standby at every moving-and-ejecting operation" should be performed is set to 75° C. Furthermore, the temperature (corresponding to "a second temperature") for judging whether or not "(B) capping standby" should be performed is set to 85° C. Furthermore, the temperature range in which the inkjet printer 1 can operate is set to at least −20° C. and at most 100° C.

When the controller 126 judges whether or not it is necessary to stop the operation in which the drive signal ODRV is generated by the drive signal generating circuit 222, the controller 126 first acquires detected temperature T of the temperature sensor 88 (S402). Next, the controller 126 checks whether or not the detected temperature T that has been acquired is at least −20° C. and lower than 100° C. (S404). Herein, if the detected temperature T that has been acquired is not at least −20° C. or lower than 100° C., then it is determined that the temperature is out of the range in which the inkjet printer 1 can operate, and the procedure proceeds to step S418, where the controller 126 determines that the printing process is to be stopped (S418). Subsequently, the controller 126 terminates the process.

On the other hand, if the detected temperature T that has been acquired is at least −20° C. and lower than 100° C., then the procedure proceeds to step S406, where the controller 126 checks whether or not the detected temperature T that has been acquired is at least 75° C. and lower than 100° C. (S406). Herein, if the detected temperature T that has been acquired is not at least 75° C. or lower than 100° C., then the controller 126 determines that the temperature of the transistors Q1 and Q2 is not at high temperature and judges that there is no need for the standby operation (S416). Subsequently, the controller 126 terminates the process.

On the other hand, if the detected temperature T that has been acquired is at least 75° C. and lower than 100° C., then the procedure proceeds to step S408, where the controller 126 checks whether or not the detected temperature T that has been acquired is at least 75° C. and lower than 85° C. (S408). Herein, if the detected temperature T that has been acquired is at least 75° C. and lower than 85° C., then the controller 126 determines that the temperature at the transistors Q1 and Q2 has not reached such high temperature and judges that "(A) standby at every moving-and-ejecting operation" should be performed (S414). Subsequently, the controller 126 terminates the process.

On the other hand, if the detected temperature T that has been acquired is not at least 75° C. or lower than 85° C., then the procedure proceeds to step S410, where the controller 126 checks whether or not the detected temperature T that has been acquired is at least 85° C. and lower than 100° C. (S410). Herein, if the detected temperature T that has been acquired is at least 85° C. and lower than 100° C., then the controller 126 determines that the temperature at the transistors Q1 and Q2 has become very high and judges that "(B) capping standby" should be performed (S412). Subsequently, the controller 126 terminates the process. On the other hand, if the detected temperature T that has been acquired is not at least 85° C. or lower than 100° C., then it is determined as an error and the procedure returns to step 402, where the controller 126 again acquires the detected temperature T from the temperature sensor 88 (S402).

It should be noted that although the temperature ("the first temperature") for judging whether or not "(A) standby at every moving-and-ejecting operation" should be performed is set to 75° C., and the temperature ("the second temperature") for judging whether or not "(B) capping standby" should be performed is set to 85° C. in this embodiment, it is not necessarily required that the temperature is set to these temperatures.

Furthermore, when the detected temperature T of the temperature sensor 88 is at least 85° C., only "(B) capping standby" is performed in this embodiment. However, both "(A) standby at every moving-and-ejecting operation" and "(B) capping standby" may be performed. In this way, an increase in the temperature at the transistors Q1 and Q2 can be further suppressed.

<Regarding Standby Time>

With respect to the standby time in "(A) standby at every moving-and-ejecting operation" and "(B) capping standby", the length of the standby times may be made different in accordance with the detected temperature T from the temperature sensor 88.

FIGS. 20A and 20B illustrate an example of a case in which the standby time is set differently in accordance with the detected temperature T from the temperature sensor 88. FIG. 20A shows the standby time in "(A) standby at every moving-and-ejecting operation". FIG. 20B shows the standby time in "(B) capping standby".

In the case of "(A) standby at every moving-and-ejecting operation", as illustrated in FIG. 20A, if the detected temperature T from the temperature sensor 88 is at least 75° C. and lower than 85° C., then the standby time is set to 1.0 second, for example. Furthermore, if the detected temperature T from the temperature sensor 88 is at least 80° C. and lower than 85° C., then the standby time is set to 2.0 seconds.

In the case of "(B) capping standby", as illustrated in FIG. 20B, if the detected temperature T from the temperature sensor 88 is at least 85° C. and lower than 90° C., then the standby time is set to 15.0 seconds, for example. Furthermore, if the detected temperature T from the temperature sensor 88 is at least 90° C. and lower than 95° C., then the standby time is set to 30.0 seconds. Furthermore, if the detected temperature T from the temperature sensor 88 is at least 95° C. and lower than 100° C., then the standby time is set to 60.0 seconds.

When the length of the standby time is set in accordance with the detected temperature T from the temperature sensor 88 in this manner, it is possible to set a more appropriate standby time. Thus, it is possible to further suppress an increase in the temperature at the transistors Q1 and Q2 while preventing the throughput from decreasing.

<Judgment Timing>

The timings described below may be adopted as the timing at which the controller 126 judges whether "(A) standby at every moving-and-ejecting operation" should be performed or "(B) capping standby" should be performed, based on the detected temperature from the temperature sensor 88.

(1) When Printing is Started

This include the timing at which a print command is received from the external computer 140 and the timing at which a medium to be printed is supplied (including before and after the paper supply), for example. It is performed before printing on a medium is started. When the temperature of the transistors Q1 and Q2 is checked before printing is started, and the standby operation is performed if necessary, it is possible to prevent the transistors Q1 and Q2 from entering a high-temperature state. In addition to the above, the timing at which printing is started includes the timing after a print command has been received from the external computer 140 and a further print command is received, for example.

(2) Every Page

When printing is carried out on a plurality of pieces of media based on a print command that has been sent from the external computer 140, the temperature at the transistors Q1 and Q2 may be checked every time a medium is printed. Accordingly, when a plurality of media are printed in succession, it is possible to suppress an increase in the temperature at the transistors Q1 and Q2, so that the transistors Q1 and Q2 are prevented from being damaged.

It should be noted that, as regards the judgment timing of the controller 126, judgment may be performed by the controller 126 at a timing other than the timings (1) and (2).

<Capping Standby Timing>

As the timing at which "(B) capping standby" is performed, the timing before printing is started, for example, the timing before or after paper supply is conceivable. In addition to the above, it may be performed also during printing. For example, it is possible to perform the capping standby operation when the printing process is being performed on a particular medium by ejecting ink from the nozzles #1 to #180 while the carriage 41 moves in the carriage movement direction, and then to resume the printing process. More specifically, the timing may be either the timing at which printing is started or the timing while printing is being processed, as long as it is before execution of the moving-and-ejecting operation in which the printing process is performed on a particular media by ejecting ink from the nozzles #1 to #180 while the carriage 41 moves in the carriage movement direction.

<Other Process Examples>

Figure 21A:
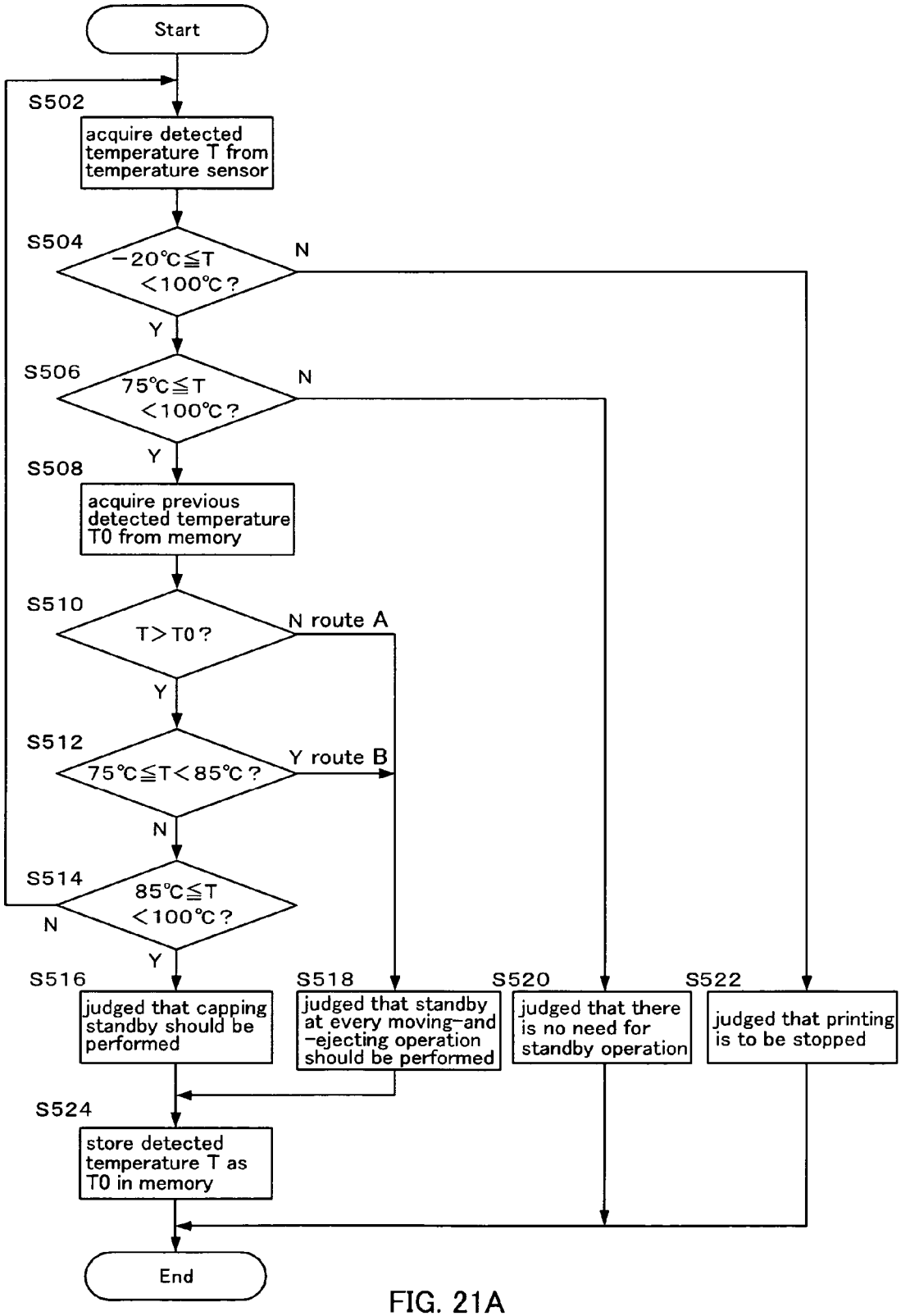
FIG. 21A is a flowchart illustrating another process example of the controller.

FIG. 21A is a flowchart illustrating another process example of the controller 126. Herein, when the detected temperature acquired from the temperature sensor 88 is at least 75° C. and at most 100° C., the detected temperature is stored in the memory, for example. Then, when the detected temperature acquired from the temperature sensor 88 is at least 75° C. and at most 100° C., the temperature is compared with the previous detected temperature (the detected temperature of the previous time) that is stored in the memory such as the main memory 127. Different standby operations are performed between a case in which the detected temperature of this time is higher than the previous detected temperature and a case in which the detected temperature of this time is lower than or equal to the previous detected temperature.

Herein, the controller 126 first acquires the detected temperature T of the temperature sensor 88 (S502). Next, the controller 126 checks whether or not the detected temperature T that has been acquired is at least −20° C. and lower than 100° C. (S504). If the detected temperature T that has been acquired is not at least −20° C. or lower than 100° C., then it is determined that the temperature is out of the range in which the inkjet printer 1 can operate, and the procedure proceeds to step S522, where the controller 126 determines that the printing process is to be stopped (S522). Subsequently, the controller 126 terminates the process.

On the other hand, if the detected temperature T that has been acquired is at least −20° C. and lower than 100° C., then the procedure proceeds to step S506, where the controller 126 checks whether or not the detected temperature T that has been acquired is at least 75° C. and lower than 100° C. (S506). Herein, if the detected temperature T that has been acquired is not at least 75° C. or lower than 100° C., then the controller 126 determines that the temperature at the transistors Q1 and Q2 is not at high temperature and judges that there is no need for the standby operation (S520). Subsequently, the controller 126 terminates the process.

Then, if the detected temperature T that has been acquired is at least 75° C. and lower than 100° C., then the procedure proceeds to step S508, where the controller 126 acquires a previous detected temperature T0 from the memory such as the main memory 127 (S508). It should be noted that the previous detected temperature T0 is set to a predetermined initial value in an initial state. Then, the controller 126 checks whether or not the detected temperature T acquired this time is higher than the previous detected temperature T0 acquired from the memory such as the main memory 127 (S510). Herein, if the detected temperature T acquired this time is not higher than the previous detected temperature T0, then regardless of the detected temperature T acquired this time, the procedure proceeds to step S518, where the controller 126 judges that "(A) standby at every moving-and-ejecting operation" should be performed (S518). Subsequently, the procedure proceeds to step S524, where the controller 126 stores the detected temperature T acquired this time as a temperature T0 in the memory such as the main memory 127. Then, the process is terminated.

On the other hand, if the detected temperature T acquired this time is higher than the previous detected temperature T0, then the procedure proceeds to step S512, where the controller 126 checks whether or not the detected temperature T that has been acquired is at least 75° C. and lower than 85° C. (S512). Herein, if the detected temperature T that has been acquired is at least 75° C. and lower than 85° C., then the controller 126 determines that the temperature at the transistors Q1 and Q2 has not reached such high temperature and judges that "(A) standby at every moving-and-ejecting operation" should be performed (S518). Subsequently, the procedure proceeds to step S524, where the controller 126 stores the detected temperature T acquired this time as a temperature T0 in the memory such as the main memory 127. Then, the process is terminated.

If the detected temperature T that has been acquired is not at least 75° C. or lower than 85° C., then the procedure proceeds to step S514, where the controller 126 checks whether or not the detected temperature T that has been acquired is at least 85° C. and lower than 100° C. (S514). Herein, if the detected temperature T that has been acquired is at least 85° C. and lower than 100° C., then the controller 126 determines that the temperature at the transistors Q1 and Q2 has become very high and judges that "(B) capping standby" should be performed (S516). Subsequently, the procedure proceeds to step S524, where the controller 126 stores the detected temperature T acquired this time as a temperature T0 in the memory such as the main memory 127. Then, the process is terminated.

On the other hand, if the detected temperature T that has been acquired is not at least 85° C. or lower than 100° C., then it is determined as an error and the procedure returns to step 502, where controller 126 again acquires the detected temperature T from the temperature sensor 88 (S502).

When the controller 126 performs this process, in a case where the detected temperature T that has been acquired from the temperature sensor 88 is not higher than the previous temperature T0 that is stored in the memory such as the main memory 127, it is possible not to perform the time-consuming standby operation such as "(B) capping standby", and it is sufficient to perform only "(A) standby at every moving-and-ejecting operation". Accordingly, it is possible to smoothly perform the printing process, so that the throughput can be improved.

It should be noted that in step S516, when the controller 126 judges that "(B) capping standby" should be performed, the length of the standby time may be changed as appropriate in accordance with the detected temperature T from the temperature sensor 88. More specifically, as illustrated in FIG. 20B, the length of the standby time may be set as appropriate in accordance with the detected temperature T from the temperature sensor 88, for example.

Furthermore, also in step S518, when the controller 126 judges that "(A) standby at every moving-and-ejecting operation" should be performed, the length of the standby time may be changed as appropriate depending on the detected temperature T from the temperature sensor 88. In this case, the methods for setting the standby time become different depending on the route to step S518. More specifically, different methods for setting the standby time are applied, depending on the detected temperature T, between: a case in which the detected temperature T acquired this time is not higher than the previous detected temperature T0 and thus it is judged that "(A) standby at every moving-and-ejecting operation" should be performed, that is, in a case of "route A" in which the procedure proceeds from step S510 to step 518 (see FIG. 21A); and a case in which the detected temperature T acquired this time is higher than the previous detected temperature T0, and the detected temperature T acquired this time is at least 75° C. and lower than 85° C., and thus it is judged that "(A) standby at every moving-and-ejecting operation" should be performed, that is, in a case of "route B" in which the procedure proceeds from step S510 via step S512 to step 518 (see FIG. 21A).

In the case or "route B", the range of the detected temperature T is at least 75° C. and lower than 85° C., and thus the standby time is set with respect to this range. More specifically, it is possible to set the standby time as illustrated in FIG. 20A, for example. On the other hand, in the case of "route A", the range of the detected temperature T is at least 75° C. and lower than 100° C., and thus it is necessary to set the standby time with respect to this range. Thus, it is necessary to prepare a new table that is different from FIG. 20A.

FIG. 21B shows an example of a new table that is prepared herein. In this table, if the detected temperature T from the temperature sensor 88 is at least 75° C. and lower than 85° C., then the standby time is set to 1.0 second. Furthermore, if the detected temperature T from the temperature sensor 88 is at least 85° C. and lower than 95° C., then the standby time is set to 2.0 seconds. Furthermore, if the detected temperature T from the temperature sensor 88 is at least 95° C. and lower than 100° C., then the standby time is set to 5.0 seconds.

===Micro-vibration===

The drive signal generating circuit 222 of this embodiment can output a micro-vibration signal SDRV for causing the piezo elements to vibrate to an extent that ink is not ejected from the nozzles #1 to #180, in addition to the drive signal ODRV for causing the piezo elements to perform an operation of causing ink to be ejected from the nozzles #1 to #180.

Figure 22:
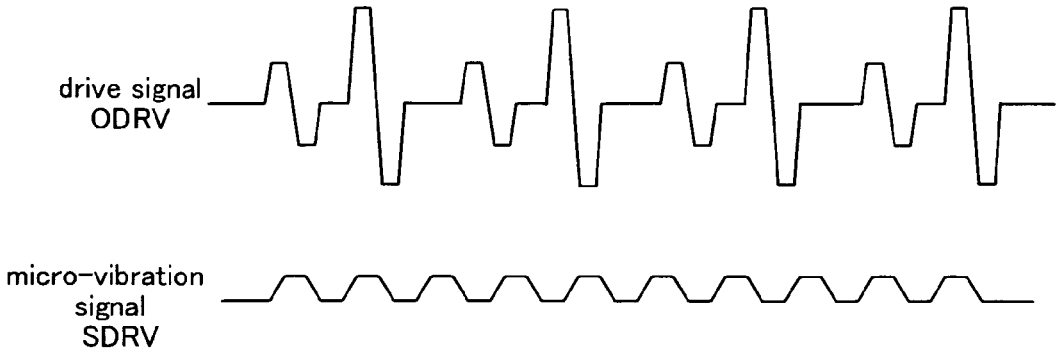
FIG. 22 is an explanatory diagram of a micro-vibration signal.

FIG. 22 shows a drive signal ODRV and a micro-vibration signal SDRV. The micro-vibration signal SDRV is constituted by pulses in a predetermined period. The micro-vibration signal SDRV has a smaller amplitude than the drive signal ODRV. When this micro-vibration signal SDRV is input to the piezo elements, the piezo elements vibrate to an extent that ink is not ejected from the nozzles #1 to #180. When the piezo elements vibrate in this manner, it is possible to prevent ink in the nozzles #1 to #180 from being solidified. More specifically, when the piezo elements vibrate, it is possible to vibrate the meniscus of ink in the nozzles #1 to #180. Accordingly, an ejection failure such as clogging is prevented from occurring in the nozzles #1 to #180.

The micro-vibration signal SDRV is output from the drive signal generating circuit 222 while ink is not being ejected from the nozzles #1 to #180 toward the medium S. For example, in this embodiment, the micro-vibration signal SDRV is output from the drive signal generating circuit 222 when "(A) standby at every moving-and-ejecting operation" is being performed. In addition to the above, it is preferable that the micro-vibration signal SDRV is output without fail while ink is not being ejected from the nozzles #1 to #180 toward the medium S.

When "(B) capping standby" is performed, that is, when the carriage 41 has moved to the home position and the head 21 is blocked with the capping device 35, the output of the micro-vibration signal SDRV from the drive signal generating circuit 222 is stopped. Thus, when the head 21 is blocked with the capping device 35, a current hardly flows in the two transistors Q1 and Q2 (see FIG. 14) constituting the current amplifier circuit of the drive signal generating circuit 222, so that it is possible to prevent heat from being generated at the transistors Q1 and Q2. Accordingly, compared with the case of "(A) standby at every moving-and-ejecting operation", heat can be released from the two transistors Q1 and Q2, and thus it is possible to suppress an increase in the temperature at the two transistors Q1 and Q2.

===Effect===

Figure 23:
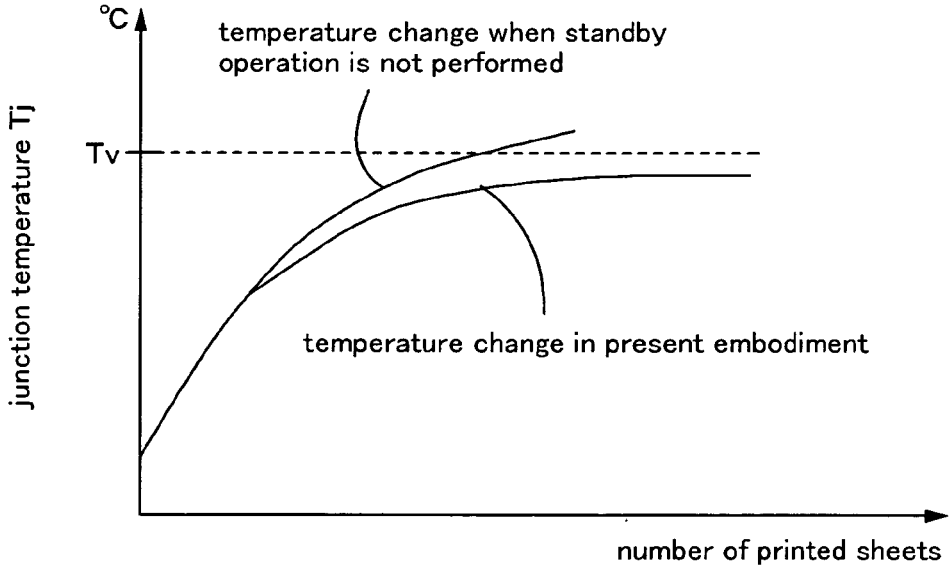
FIG. 23 is a contrast diagram of the temperature change in the Junction temperature.

FIG. 23 is a graph of the change in the junction temperature Tj in a case where the printing process is actually performed in succession. The vertical axis of the graph shows the temperature (° C.), and the horizontal axis shows the number of printed sheets.

In a case where the standby operation is not performed, when the printing process is continued as shown in FIG. 23, the junction temperature Tj continues to rise. Then, when the printing process is continued for a while, the junction temperature reaches a limit temperature Tv, leading to a possibility that the transistors Q1 and Q2 are damaged.

On the other hand, in a case where the standby operation is performed as in this embodiment, when the junction temperature Tj becomes high as shown in FIG. 23, the controller 126 performs the standby operation. Thus, the printing process is halted at a point midway in the process and thus the print speed is decreased, but an increase in the junction temperature is suppressed, and thus it is possible to prevent the transistors Q1 and Q2 from being damaged. Accordingly, in this embodiment, compared with a case in which the standby operation is not performed, it is possible to increase the number of media that can be printed in succession.

Furthermore, in this embodiment, if the detected temperature from the temperature sensor 88 is not so high, then "(A) standby at every moving-and-ejecting operation" is performed, and if the detected temperature from the temperature sensor 88 becomes very high, then "(B) capping standby" is performed. Thus, it is possible to suppress an increase in the temperature at the transistors Q1 and Q2 by performing "(A) standby at every moving-and-ejecting operation", before performing "(B) capping standby". Accordingly, it is possible to prevent the process speed from significantly decreasing due to "(B) capping standby" being performed. In other words, it is possible to prevent the throughput from decreasing while suppressing an increase in the temperature at the transistors Q1 and Q2.

FIG. 24 shows the number of printed sheets in a case where only "(B) capping standby" is performed and in a case where both of "(B) capping standby" and "(A) standby at every moving-and-ejecting operation" are performed. In the case where only "(B) capping standby" is performed, the number of printed sheets is 30 when the printing process is performed in the same condition. However, in the case where both "(B) capping standby" and "(A) standby at every moving-and-ejecting operation" are performed, the number of printed sheets is 45 in the same condition, which makes it clear that the number of printed sheets is increased. Thus, it is clarified that when "(A) standby at every moving-and-ejecting operation" is performed in addition to "(B) capping standby", an increase in the temperature at the transistors Q1 and Q2 is suppressed.

===Overview===

As described above, with the inkjet printer 1 according to this embodiment, when printing is carried out on a medium by ejecting ink from the nozzles #1 to #180, the detected temperature is acquired from the temperature sensor 88, and based on the detected temperature, it is judged whether or not"(A) standby at every moving-and-ejecting operation" should be performed and whether or not "(B) capping standby" should be performed. Thus, it is possible to perform an appropriate cooling down process in accordance with the detected temperature. Accordingly, it is possible to enhance processing speed (throughput) by shortening the standby time, while suppressing an increase in the temperature due to heat generation at the transistors Q1 and Q2.

Especially, if the detected temperature of the temperature sensor 88 becomes higher than the first temperature (75° C.), then "(A) standby at every moving-and-ejecting operation" is performed. Furthermore, if the detected temperature becomes higher than the second temperature (85C), then "(B) capping standby" is performed. Thus, the number of times of "(B) capping standby" in which the standby time is long can be reduced to the extent possible, so that it is possible to enhance processing speed (throughput) by shortening the standby time.

===Configuration of Printing System etc.===

Figure 25:
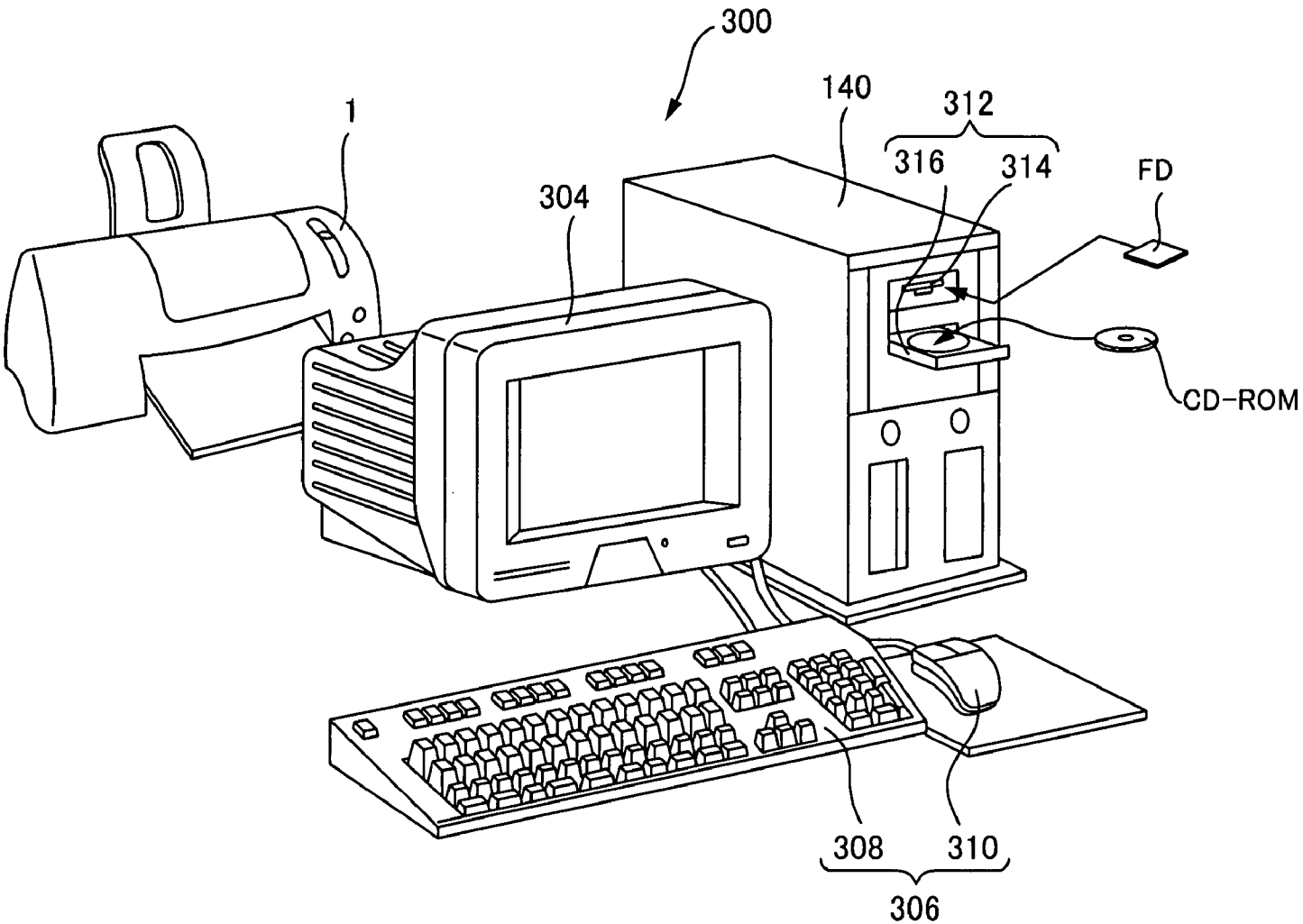
FIG. 25 is a perspective view showing the appearance of an example of a printing system.

The following is a description concerning an example in which the inkjet printer 1 is provided as a printing apparatus, as an embodiment of a printing system according to the present invention. FIG. 25 shows the appearance configuration of an embodiment of a printing system according to the present invention. A printing system 300 is provided with the computer 140, a display device 304, and an input device 306. The computer 140 is constituted by various computers such as a personal computer.

The computer 140 is provided with a reading device 312 such as an FD drive 314 and a CD-ROM drive 316. In addition to the above, the computer 140 may be provided with, for example, an MO (magnet optical) disk drive and a DVD drive. Furthermore, the display device 304 is constituted by various display devices such as a CRT display, a plasma display, a liquid crystal display. The input device 306 is constituted by, for example, a keyboard 308 and a mouse 310.

Figure 26:
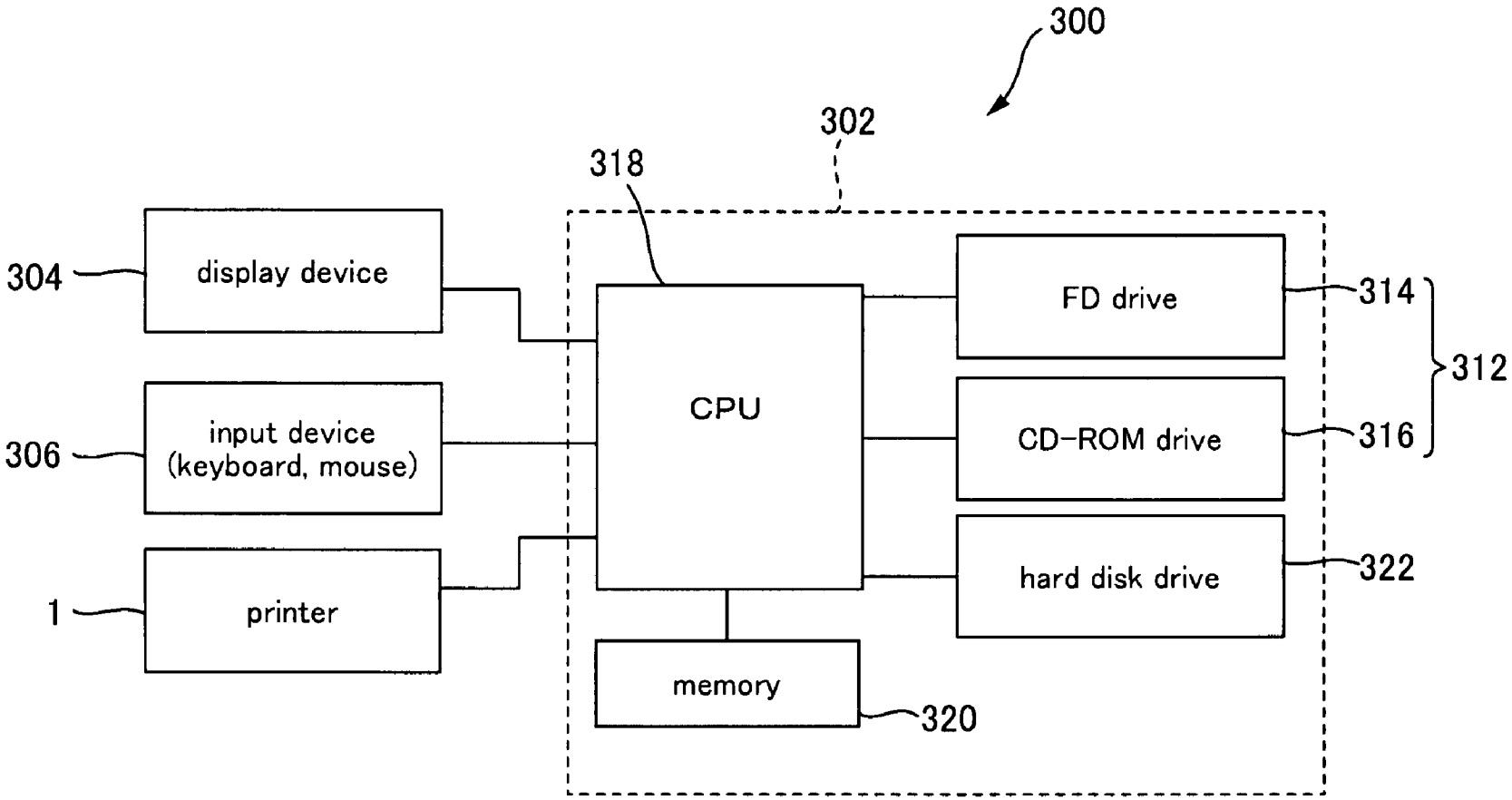
FIG. 26 is a block diagram showing the system configuration of an example of the printing system.

FIG. 26 is a block diagram showing an example of the system configuration of the printing system of this embodiment. The computer 140 is provided with a CPU 318, a memory 320, and a hard disk drive 322 in addition to the reading device 312 such as the FD drive 314 and the CD-ROM drive 316.

The CPU 318 performs overall control of the computer 140. Furthermore, various types of data is stored in the memory 320. A printer driver, for example, as a program for controlling a printing apparatus such as the inkjet printer 1 according to this embodiment is installed in the hard disk drive 322. The CPU 318 reads out a program such as the printer driver stored in the hard disk drive 322 and operates according to the program. Furthermore, the CPU 318 is connected to, for example, the display device 304, the input device 306, and the inkjet printer 1 arranged outside the computer 140.

As an overall system, the printing system 300 that is thus achieved is superior to conventional systems.

===Other Embodiments===

In the description above, based on an embodiment, a printing apparatus according to the present invention was described by taking the inkjet printer 1 as an example. However, the foregoing embodiment is for the purpose of elucidating the present invention and is not to be interpreted as limiting the present invention. The invention can of course be altered and improved without departing from the gist thereof and includes equivalents. In particular, the embodiments described below are also included in the printing apparatus according to the present invention.

<Regarding the Carry Mechanism>

The carry mechanism in the foregoing embodiment is not limited to the carry mechanism with the above-described configuration, and the carry mechanism with other configurations may be employed. In this case, it is preferable to employ an appropriate carry mechanism in accordance with, for example, the type of a medium that is to be printed.

<Regarding the Moving-and-Ejecting Operation>

In the foregoing embodiment, the moving-and-ejecting operation was described by taking as an example an operation of ejecting ink from the nozzles toward a medium while moving a carriage relative to the medium, but is not limited to this operation. More specifically, in "moving-and-ejecting operation" described herein, any type of nozzles may be employed as long as they are nozzles for performing the moving-and-ejecting operation of ejecting ink toward a medium while moving relative to the medium, during an intermission of a carrying operation performed by the carry mechanism.

<Regarding the Nozzles>

In the foregoing embodiment, as "nozzles", a plurality of nozzles that are arranged in tandem so as to form a straight line for each color, herein, for cyan (C), magenta (M), yellow (Y), and black (K) at the head 21 were described. However, the nozzles described herein are not necessarily limited to the nozzles of this type. More specifically, it is not necessary that a plurality of nozzles are provided as in the foregoing embodiment, as long as a nozzle ejects ink toward the medium S. Furthermore, it is not necessary that nozzles are arranged in a straight line for each color to form nozzle rows.

<Regarding the Ink Ejection Mechanism>

In the foregoing embodiment, a mechanism of ejecting ink using piezo elements as the piezoelectric elements was explained. However, the mechanism of ejecting ink is not limited to a mechanism of ejecting ink using this method, and any method may be employed as long as a mechanism of ejecting ink is used, such as a method for ejecting ink by generating bubbles in the nozzles with heat or the like, and other methods.

<Regarding the Elements>

In the foregoing embodiment, "elements for performing an operation for causing ink to be ejected" were described by taking as an example a case in which piezo elements (piezoelectric vibrators) are used. However, "elements" are not limited to these piezo elements. More specifically, any elements may be employed as long as they are elements for performing the operation for causing ink to be ejected.

<Regarding the Operation for Causing Ink to be Ejected from Nozzles>

In the foregoing embodiment, "an operation for causing ink to be ejected from the nozzles" was described as the operation in which elements are expanded or constricted. However, the operation for causing ink to be ejected from the nozzles is not necessarily limited to this operation. More specifically, any operation is included in the operation for causing ink to be ejected from the nozzles as long as it is an operation for causing ink to be ejected from the nozzles or the like.

<Regarding the Drive Signal>

In the foregoing embodiment, "a drive signal" was described by taking the drive signal having the waveform in the shape as shown in FIGS. 7 and 22 as an example. However, the drive signal described herein is not limited to the drive signal having the waveform in such a shape. More specifically, even when it is a drive signal having other waveforms, as long as it is "a signal for causing the elements to perform an operation for causing ink to be ejected", any signal is included in the drive signal.

<Regarding the Drive Signal Outputting Section>

In the foregoing embodiment, "a drive signal outputting section" was described by taking the drive signal generating circuit 222 as illustrated in FIGS. 12, 13, and 14 as an example. However, the drive signal outputting section described herein is not necessarily limited to this drive signal generating circuit 222. More specifically, any type of drive signal outputting section may be employed as long as it can output a drive signal.

<Regarding the Ink>

The ink that is used may be pigment ink or may be other various types of ink such as dye ink.

As for the color of the ink, it is also possible to use ink of other colors, such as light cyan (LC), light magenta (LM), dark yellow (DY), or red, violet, blue or green, in addition to the above-described yellow (Y), magenta (M), cyan (C) and black (K).

<Regarding the Cap>

In the foregoing embodiment, "a cap" was described by taking as an example the capping device 35 in which the ejection openings of the nozzles #1 to #180 in each of the nozzle rows 211C, 211M, 211Y, and 211K that are provided at the head 21 are covered and thus blocked by the movement of the carriage. However, the cap described herein is not necessarily limited to this capping device 35. More specifically, any types of cap may be employed as long as it blocks the ejection openings of the nozzles that are provided at the head or the like.

<Regarding the Printing Apparatus>

In the foregoing embodiment, a printing apparatus was described by taking the above-described inkjet printer 1 as an example, but it is not limited to such a printing apparatus, and an inkjet printer for ejecting ink in other methods also may be employed.

<Regarding the Medium>

The medium S may be any of plain paper, matte paper, cut paper, glossy paper, roll paper, print paper, photo paper, and roll-type photo paper or the like. In addition to these, the medium S may be a film material such as OHP film and glossy film, a cloth material, or a metal plate material or the like. In other words, any medium that can be printed on may be employed.

What is claimed is:

1. A printing apparatus, comprising:

a carry mechanism for carrying a medium;

a nozzle for performing a moving-and-ejecting operation of ejecting ink toward the medium while moving relative to the medium during an intermission of a carrying operation performed by the carry mechanism;

an element for performing an ink ejecting operation for causing the ink to be ejected from the nozzle;

a drive signal outputting section for outputting a drive signal for causing the element to perform the ink ejecting operation;

a temperature sensor for detecting a temperature of the drive signal outputting section or in the vicinity thereof;

a cap for blocking an ejection opening of the nozzle; and a controller that, when printing is carried out on the medium by ejecting the ink from the nozzle, is adapted to:

perform, at least once between the moving-and-ejecting operation and the carrying operation, a first standby operation in which neither the moving-and-ejecting operation nor the carrying operation is performed for a first predetermined time, if a detected temperature detected by the temperature sensor is higher than a first temperature, and perform, before performing the moving-and-ejecting operation, a second standby operation in which standby is performed for a second predetermined time that is longer than said first predetermined time by blocking the ejection opening of the nozzle with the cap, if the detected temperature is higher than a second temperature that is higher than the first temperature, wherein the cap does not block the ejection opening of the nozzle in the first standby operation.

2. A printing apparatus according to claim 1, wherein the element is constituted by a piezoelectric element.

3. A printing apparatus according to claim 1, wherein the drive signal outputting section has a current amplifier circuit that is provided with a transistor.

4. A printing apparatus according to claim 1, wherein said first predetermined time is set differently in accordance with the detected temperature of the temperature sensor.

5. A printing apparatus according to claim 1, wherein said second predetermined time is set differently in accordance with the detected temperature of the temperature sensor.

6. A printing apparatus according to claim 1, wherein the first standby operation is performed every time the moving-and-ejecting operation is performed.

7. A printing apparatus according to claim 1, wherein the second standby operation is performed when the nozzle has moved to a predetermined position.

8. A printing apparatus according to claim 1, wherein the second standby operation is performed before printing is carried out on the medium.

9. A printing apparatus according to claim 1, wherein, when printing is carried out on the medium by ejecting the ink from the nozzle, the controller performs the first standby operation in addition to the second standby operation, if the detected temperature of the temperature sensor is higher than the second temperature.

10. A printing apparatus according to claim 1, further comprising:

a memory for storing a detected temperature detected with the temperature sensor when the first standby operation or the second standby operation is performed, wherein, when printing is carried out on the medium by ejecting the ink from the nozzle, the controller compares the detected temperature of a previous time stored in the memory with a detected temperature of this time detected with the temperature sensor, and does not perform the second standby operation if the detected temperature of this time is not higher than the detected temperature of the previous time.

11. A printing apparatus according to claim 1, wherein in addition to the drive signal, the drive signal outputting section outputs a different drive signal for vibrating the element to an extent that the element does not perform the ink ejecting operation.

12. A printing apparatus according to claim 11, wherein the different drive signal is output when the first standby operation is being performed.

13. A printing apparatus according to claim 11, wherein the different drive signal is not output when the second standby operation is being performed.

14. A printing method, comprising:

when printing is carried out on a medium by performing a moving-and-ejecting operation of ejecting ink from a nozzle toward the medium while moving the nozzle relative to the medium during an intermission of a carrying operation of carrying the medium, acquiring a detected temperature from a temperature sensor that detects a temperature of a drive signal outputting section for outputting a drive signal for causing an element to perform an ink ejecting operation for causing the ink to be ejected from the nozzle, or a temperature in the vicinity of the drive signal outputting section; and performing, the at least once between the moving-and-ejecting operation and the carrying operation, a first standby operation in which neither the moving-and-ejecting operation nor the carrying operation is performed for a first predetermined time, if the detected temperature of the temperature sensor is higher than a first temperature, and performing, before performing the moving-and-ejecting operation, a second standby operation in which standby is performed for a second predetermined time that is longer than said first predetermined time by blocking the ejection opening of the nozzle with a cap, if the detected temperature is higher than a second temperature that is higher than the first temperature, wherein the cap does not block the ejection opening of the nozzle in the first standby operation.

15. A printing system, comprising:

a computer; and a printing apparatus that is connectable to the computer and that includes:

a carry mechanism for carrying a medium, a nozzle for performing a moving-and-ejecting operation of ejecting ink toward the medium while moving relative to the medium during an intermission of a carrying operation performed by the carry mechanism, an element for performing an ink ejecting operation for causing the ink to be ejected from the nozzle, a drive signal outputting section for outputting a drive signal for causing the element to perform the ink ejecting operation, a temperature sensor for detecting a temperature of the drive signal outputting section or in the vicinity thereof, a cap for blocking an ejection opening of the nozzle, and a controller that, when printing is carried out on the medium by ejecting the ink from the nozzle, is adapted to:

perform, at least once between the moving-and-ejecting operation and the carrying operation, a first standby operation in which neither the moving-and-ejecting operation nor the carrying operation is performed for a first predetermined time, if a detected temperature detected by the temperature sensor is higher than a first temperature, and perform, before performing the moving-and-ejecting operation, a second standby operation in which standby is performed for a second predetermined time that is longer than the said first predetermined time by blocking the ejection opening of the nozzle with the cap, if the detected temperature is higher than a second temperature that is higher than the first temperature, wherein the cap does not block the ejection opening of the nozzle in the first standby operation.

* * * * *